US009406288B2

(12) United States Patent
Ohnishi et al.

(10) Patent No.: US 9,406,288 B2
(45) Date of Patent: Aug. 2, 2016

(54) ACTUATOR FOR VIBRATING A SOUND BOARD IN A MUSICAL INSTRUMENT AND METHOD FOR ATTACHING SAME

(71) Applicant: Yamaha Corporation, Hamamatsu-Shi, Shizuoka-Ken (JP)

(72) Inventors: Kenta Ohnishi, Hamamatsu (JP); Yuji Takahashi, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 14/364,173

(22) PCT Filed: Dec. 14, 2012

(86) PCT No.: PCT/JP2012/082547

§ 371 (c)(1),
(2) Date: Jun. 10, 2014

(87) PCT Pub. No.: WO2013/089239

PCT Pub. Date: Jun. 20, 2013

(65) Prior Publication Data

US 2015/0128790 A1 May 14, 2015

(30) Foreign Application Priority Data

Dec. 15, 2011 (JP) ..... 2011-274365
Dec. 15, 2011 (JP) ..... 2011-274366

(51) Int. Cl.
*G10H 3/22* (2006.01)
*G10H 1/32* (2006.01)
(Continued)

(52) U.S. Cl.
CPC . *G10H 1/32* (2013.01); *G10H 3/22* (2013.01); *H04R 9/04* (2013.01); *H04R 31/00* (2013.01);
(Continued)

(58) Field of Classification Search
CPC ..... G10H 3/22
USPC ..... 84/622
See application file for complete search history.

(56) References Cited

U.S. PATENT DOCUMENTS 2,001,392 A * 5/1935 Miessner ..... G10H 3/18 84/192
4,514,599 A 4/1985 Yanagishima et al.
(Continued)

FOREIGN PATENT DOCUMENTS

CN 1901032 A 1/2007
JP S46-17839 B1 5/1971
(Continued)

OTHER PUBLICATIONS

International Search Report for PCT/JP2012/082547, mailing date Mar. 5, 2013.
(Continued)

*Primary Examiner* — David Warren
(74) *Attorney, Agent, or Firm* — Blank Rome LLP

(57) ABSTRACT

In an actuator (50), a bobbin (511) to which a voice coil (513) is attached is disposed within a magnetic path space formed by a magnetic path forming section (52). A connecting shaft (514) is coupled to the bobbin (511), and a connection end portion (516A) at a distal end of the connecting shaft is connected to a sound board of a musical instrument. The length of the shaft (514) can be adjusted. When the actuator (50) is attached to the sound board, the length of the shaft (514) is adjusted and the connection end portion (516A) is connected to the sound board while a position of the voice coil (513) within the magnetic path space is maintained in a predetermined reference mounting position, in a state in which the magnetic path forming unit (52) is supported in a predetermined position by a support unit (55).

14 Claims, 18 Drawing Sheets

(51) Int. Cl.

| | |
|---|---|
| ***H04R 31/00*** | (2006.01) |
| ***H04R 9/04*** | (2006.01) |
| *H04R 1/02* | (2006.01) |
| *H04R 11/02* | (2006.01) |
| *H04R 7/04* | (2006.01) |
| *H04R 9/02* | (2006.01) |

(52) U.S. Cl.
CPC .... *G10H 2220/501* (2013.01); *G10H 2220/505* (2013.01); *H04R 1/028* (2013.01); *H04R 7/045* (2013.01); *H04R 9/02* (2013.01); *H04R 11/02* (2013.01); *H04R 31/006* (2013.01); *H04R 2209/024* (2013.01); *H04R 2440/05* (2013.01); *H04R 2440/07* (2013.01); *Y10T 29/49005* (2015.01)

(56) References Cited

U.S. PATENT DOCUMENTS

| | | | | |
|---|---|---|---|---|
| 5,247,129 | A * | 9/1993 | Nozaki | G10H 1/055 84/192 |
| 2006/0110001 | A1* | 5/2006 | Saint Vincent | H04R 7/20 381/396 |
| 2007/0017353 | A1* | 1/2007 | Kunisada | G10C 1/00 84/723 |
| 2008/0127798 | A1* | 6/2008 | Sato | G10H 3/146 84/192 |
| 2009/0232333 | A1 | 9/2009 | Kondo et al. | |
| 2010/0147132 | A1* | 6/2010 | Shinjo | G10H 1/32 84/192 |
| 2010/0192756 | A1* | 8/2010 | Kato | G10H 1/32 84/744 |
| 2013/0118333 | A1* | 5/2013 | Ohnishi | G10C 3/06 84/192 |
| 2014/0202321 | A1* | 7/2014 | Ohnishi | G10C 3/06 84/744 |
| 2015/0128790 | A1* | 5/2015 | Ohnishi | G10H 1/32 84/725 |

FOREIGN PATENT DOCUMENTS

| | | | |
|---|---|---|---|
| JP | S56-96783 | U | 7/1981 |
| JP | S58-48187 | U | 3/1983 |
| JP | S64-51900 | A | 2/1989 |
| JP | 2005-064831 | A | 3/2005 |
| JP | 2007-328186 | A | 12/2007 |
| JP | 2008-310055 | A | 12/2008 |
| JP | 2009-225034 | A | 10/2009 |
| WO | WO 90/03025 | A1 | 3/1990 |

OTHER PUBLICATIONS

Korean Office Action for corresponding Korean Application No. 10-2014-7015861 dated Aug. 20, 2015.

European Supplementary Partial Search Report for Corresponding European Application No. 12857362.3.

Supplementary European Search Report dated Mar. 2, 2016 from EP Patent Application No. 12857362.3.

Office Action from CN Patent Application No. 201280069876.0 dated Feb. 3, 2016.

* cited by examiner

ACTUATOR FOR VIBRATING A SOUND BOARD IN A MUSICAL INSTRUMENT AND METHOD FOR ATTACHING SAME

TECHNICAL FIELD

The present invention relates to a voice coil type actuator for positively imparting vibration to a sound board of a musical instrument and a method for attaching the actuator to the musical instrument, as well as a musical instrument provided with the actuator and a method for manufacturing the same.

BACKGROUND ART

In electronic pianos, electronic tones (sounds) are audibly generated or sounded through an electromagnetic speaker. In some of the electronic pianos too, a sound board is provided to generate not only electronic tones but also natural spreading of tones and rich low-pitched tones. Patent Literature 1 discloses a technique in accordance with which an electromagnetic speaker is mounted on the sound board to vibrate the sound board with the electromagnetic speaker so that a tone is radiated from the sound board.

PRIOR ART LITERATURE

Patent Literature 1: Japanese Translation of PCT International Application No. HEI-4-500735

To vibrate the sound board, there is employed, for example, a voice coil type actuator that generates drive force by inputting a drive signal to a voice coil disposed on a path of magnetic lines of force (magnetic path). Because such an actuator is similar in construction to a voice coil type speaker, it is possible to reduce necessary cost. In order to obtain stable drive force, it is desirable that the actuator be mounted in such a manner that variation in the number of coil winding turns of the vibrating voice coil present in the magnetic path is minimized. For example, such variation decreases as a dimension, in a vibrating direction, of the voice coil is increased. But, as such a dimension, in the vibrating direction, of the voice coil increases, inductance increases, so that frequencies at which good responsiveness can be obtained would be limited to low frequencies. To avoid such an inconvenience, it is necessary that the dimension, in the vibrating direction, of the voice coil be set to equal a length of a dimension, in the vibrating direction, of the magnetic path plus a maximum amplitude of the voice coil or such a length plus a length of play (or clearance). In that case, in order to obtain stable drive force, there arises a need to accurately mount a vibration section vibrating together with the voice coil and a magnetic path formation section, constructed to form a magnetic path, in such a manner that relative positions, in the vibrating direction, of the vibration section and the magnetic path formation section, have predetermined relationship. According to the technique disclosed in Patent Literature 1, a bobbin and a yoke are component parts independent of each other, and thus, the yoke is fixed to a strut or the like after the bobbin has been connected to the sound board. In such a case, there is a need to finely adjust a position, in the vibrating direction, of the bobbin in order to mount the bobbin and the yoke at their respective accurate position, and such an adjusting operation tends to be cumbersome and complicated.

Further, in the electromagnetic speaker used as the actuator for vibrating the sound board as in the aforementioned prior art technique, the voice coil attached to the bobbin is positioned in a path of magnetic lines of force (magnetic path) formed, for example, by a magnet and yokes, and a drive signal is input to the voice coil to generate drive force. In such a construction, the magnetic path is formed between the yokes opposed to each other, and the bobbin is positioned between the yokes. When a human operator mounts such an actuator on a musical instrument, it is necessary to mount the bobbin and the yokes at their respective positions in such a manner that the bobbin and the yokes do not contact each other. Patent Literature 1 discloses that the bobbin is fixed to the sound board and then the yokes are mounted in accordance with the fixed position of the bobbin. In such a case, however, cumbersome and complicated operations would be required because the human operator has to perform the operations for fixing the magnet and the yokes while finely adjusting the positions of the yokes in various directions in such a manner that the bobbin and the yokes do not contact each other.

SUMMARY OF INVENTION

It is therefore an object of the present invention to provide a voice coil type actuator which can be attached to the sound board with ease. It is another object of the present invention to provide a voice coil type actuator which can be attached to the sound board in such a manner that the voice coil is positioned at a desired ideal position within a magnetic path space of the voice coil.

It is still another object of the present invention to provide a voice coil type actuator constructed to be easily attachable to a musical instrument in such a manner that the bobbin and a magnetic path formation section do not contact each other.

In order to accomplish the above-mentioned objects, the present invention provides an actuator for vibrating a sound board of a musical instrument, which comprises: a magnetic path formation section constructed to form a magnetic path space; a bobbin having a voice coil attached thereto in such a manner that the voice coil is disposed within the magnetic path space; and a connection member connected to the bobbin and constructed to vibrate in response to vibration of the bobbin, the connection member having a connection end adapted for connection to the sound board of the musical instrument, the connection member being constructed to be adjustable in length.

According to the present invention arranged in the aforementioned manner, the end member connected to the bobbin connects the bobbin indirectly to the sound board of the musical instrument so as to transmit vibration of the bobbin (voice coil) to the sound board. The connection member is constructed to be adjustable in length, and thus, when the actuator is to be attached to the sound board, the connection member of the actuator can be connected to the sound board by mere adjustment of the length of the connection member without the magnetic path formation section and the bobbin (voice coil) being moved in position. In this way, the actuator can be attached to the sound board with an increased ease. Further, because the connection member can be connected to the sound board, by mere adjustment of the length of the connection member, with relative positional relationship between the magnetic path formation section and the bobbin (bobbin coil) maintained in a predetermined reference mounting position. Thus, according to the present invention, operations for attaching the actuator to the sound board with relative positional relationship between the magnetic path formation section and the bobbin (bobbin coil) maintained in the reference mounting position can be performed with an increased ease.

In an embodiment, the connection member may include a rod-shaped member, and a screw structure for converting rotational displacement of the rod-shaped member to linear displacement of the rod-shaped member.

In another embodiment, the connection member may include: a first member connected to the bobbin: a second member connected to the first member in such a manner that the second member is displaceable relative to the first member; and a tightening tool adapted to tighten and fix a connected portion between the first member and the second member, i.e. tighten and fix the first member and the second member relative to each other.

According to another aspect of the present invention, there is provided a musical instrument, which comprises: the aforementioned actuator; the support section supporting the magnetic path formation section; the sound board having the connection end connected thereto; a performance operator; and a signal generation section constructed to generate a drive signal indicative of an audio waveform corresponding to an operation of the performance operator, the drive signal being supplied to the actuator for driving the voice coil.

According to still another aspect of the present invention, there is provided a method for attaching the aforementioned actuator to a musical instrument, which comprises: a step of providing a support section in association with an actuator-attaching position of the sound board to which the actuator is to be attached and installing the magnetic path formation section on the support section; a step of connecting the connection end to the sound board after adjusting a length of the connection member in such a manner that the connection end is moved toward the sound board; and a step of fixing the length of the connection member having been adjusted in such a manner that the connection end is connected to the sound board.

Further, by incorporating the aforementioned actuator attaching method into the aforementioned musical instrument manufacturing method, the present invention can provide a novel and useful musical instrument manufacturing method.

According to still another aspect of the present invention, there is provided an actuator for vibrating a sound board of a musical instrument, which comprises: a magnetic path formation section constructed to form a magnetic path space; a bobbin having a voice coil attached thereto in such a manner that the voice coil is disposed within the magnetic path space; and a connection member joined to an end of the bobbin and connected to the sound board of the musical instrument, the magnetic path formation section having a portion inserted in an inner space of the bobbin, the portion inserted in the inner space having a through-hole portion formed therethrough in an axial direction of the voice coil, a mark provided on a portion of the end member opposed to the through-hole portion, the mark designating a position at which a fixation member for connecting the end member to the sound board is to be fastened.

In this actuator, the through-hole portion is formed in the portion of the magnetic path formation section inserted in the inner space of the bobbin, and the mark designating a position at which the fixation member is to be fastened is provided on the portion of the end member opposed to the through-hole portion. By the provision of such a mark, the operation for connecting the connection member to the sound board by means of the fixation member can be performed with an increased ease. Further, because the through-hole portion is formed in the portion of the magnetic path formation section inserted in the inner space of the bobbin, a tool (e.g., screwdriver) to be used in the operation for connecting the end member to the sound board by means of the fixation member (e.g., screw) can be readily introduced through the through-hole portion to a predetermined connection point. In this way, the present invention can provide a construction that effectively facilitates the operations for attaching the actuator to the sound board. Further, because, with the bobbin (voice coil) disposed within the magnetic path formation section, the fixation member (e.g., screw) can be readily introduced through the through-hole portion to the predetermined connection point so that the connection member fixing operation is performed. Thus, it is possible to eliminate a need for employing an operational sequence of first connecting the bobbin (voice coil) to the sound board and combining the magnetic path formation section to the bobbin (voice coil) as done in the prior art technique. As a result, the operations for attaching the actuator to the sound board can be performed in such a manner that the bobbin and the magnetic path formation section do no contact each other.

According to still another aspect, the present invention provides a method for attaching the aforementioned actuator to a musical instrument, which comprises: a step of providing a support section in association with an actuator-attaching position of the sound board to which the actuator is to be attached and installing the magnetic path formation section on the support section; a step of introducing, through the through-hole portion of the magnetic formation section, the fixation member to a position of the mark of the end member; and a step of fixing the end member to the sound board by means of the fixation member introduced to the position of the mark. Further, by incorporating the aforementioned actuator attaching method into the aforementioned musical instrument manufacturing method, the present invention can provide a novel and useful musical instrument manufacturing method.

According to still another aspect of the present invention, there is provided a device for vibrating a sound board of a musical instrument, which comprises: an actuator including: a magnetic path formation section constructed to form a magnetic path space; a bobbin having a voice coil attached thereto in such a manner that the voice coil is disposed within the magnetic path space; and a connection member connected to the bobbin and to the sound board of the musical instrument and adapted to transmit vibration of the bobbin to the sound board; a support section disposed in association with an actuator-attaching position of the sound board to which the actuator is to be attached; and an adjustment device constructed to adjust a relative distance of the support section to the sound board.

According to that aspect, when the actuator is to be attached to the sound board, the support section and the actuator can be moved as a unit to a position where the connection member of the actuator is to be connected to the sound board, by mere adjustment of the relative distance of the support section to the sound board, without the magnetic path formation section and the bobbin (voice coil) being moved in position within the actuator. In this way, the actuator can be attached to the sound board with an increased ease. Further, because the connection member can be connected to the sound board by mere adjustment of the support section with relative positional relationship between the magnetic path formation section and the bobbin (bobbin coil) maintained in the predetermined reference mounting position, the operations for attaching the actuator to the sound board with the relative positional relationship between the magnetic path formation section and the bobbin (bobbin coil) maintained in the reference mounting position can be performed with an increased ease.

BRIEF DESCRIPTION OF DRAWINGS

Hereinbelow, various embodiments of the present invention will be described in detail with reference to the accompanying drawings.

DESCRIPTION OF EMBODIMENTS

Figure 1:
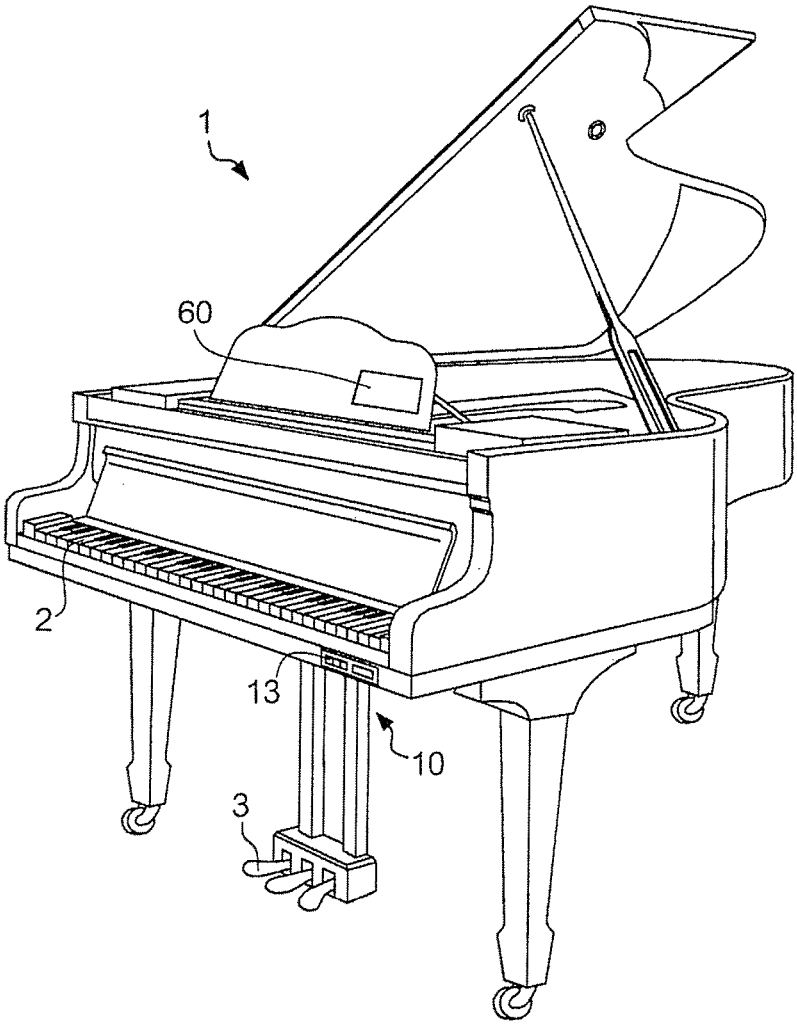
FIG. 1 is a perspective view showing an outer appearance of a grand piano according to an embodiment of the present invention.

FIG. 1 is a perspective view showing an outer appearance of a grand piano 1 according to a first embodiment of the present invention. Like the conventionally-known grand pianos, the grand piano 1 includes a keyboard having a plurality of keys 2 arranged on a front surface thereof for manual performance operations by a user or human player, and performance controlling pedals 3. The grand piano 1 also includes a control device 10 having an operation panel 13 on a front surface thereof and a touch panel 60 provided on a music stand. User's instructions can be input to the control device 10 by the user operating the operation panel 13 and the touch panel 60.

The grand piano 1 is constructed to be capable of generating sounds or tones in any one of a plurality of tone generation modes selected in accordance with an instruction by the user. Examples of such a plurality of tone generation modes include: (1) a normal tone generation mode in which is performed only tone generation based on vibration of a string set (one or more string) by a corresponding hammer as in a conventional or ordinary grand piano; (2) a weak tone mode in which is performed only tone generation based on active sound board vibration sound (that is typically a tone smaller in volume than a normal performance tone, but may be a tone larger in volume than a normal performance tone) generated from a sound board of a vibration device by, while preventing string-striking action or movement of the hammer by means of a stopper, positively physically vibrating the sound board with a drive signal based on an audio waveform signal generated by a tone generator section, such as an electronic tone generator: and (3) a vibration device strong tone mode in which is performed tone generation based on string vibration sound responsive to string striking by a corresponding hammer as in the normal tone generation mode simultaneously with tone generation based on active sound board vibration sound generated by the sound board being positively physically vibrated by a drive signal as in the weak tone mode. In the strong tone mode, not only volume is raised but also a first acoustic tone having a piano's inherent timber or tone color obtained by a hammer striking a string set and a second acoustic tone having an additional tone color obtained by compulsorily vibrating the sound board with a drive signal having a desired tone color waveform other than piano tone colors (including tone colors similar to the piano tone color) are generated simultaneously, so that a tone color layer effect can be achieved. Thus, the strong tone generation mode can function also as a performance mode achieving a tone color layer effect.

Note that the above-mentioned plurality of tone generation modes may include other tone generation modes, such as a silence mode. In the silence mode, the same construction as in the weak tone generation mode is employed, but an electronic tone waveform signal (audio waveform signal) generated by the tone generator section is supplied to a headphone terminal, instead of being used as a drive signal for vibrating the sound board, so that the human player is allowed to personally listen to a tone based on the electronic tone waveform signal (i.e. the tone is not audibly generated to an external space).

Table 1 below lists the aforementioned various tone generation modes.

TABLE 1

| | function for preventing string striking by a hammer | |
|---|---|---|
| | invalid (string striking effected) | valid (string striking not effected) |
| vibration by a vibration section not effected | capable of playing with performance specific to a piano without an acoustic piano sound board characteristic being influenced (normal tone generation mode) | silent piano whose tone is listened to with a headphone without the tone being output outside (silence mode) |
| vibration by the vibration section effected (piano tone color) | capable of achieving an effect like Honky-tonk piano by not only raising volume but also consciously shifting tuning (strong tone mode) | obtain natural resonance effect with resonance of weak tone (strong tone) piano string kept valid (weak tone mode) |
| vibration by the vibration section effected (non-piano tone color) | obtain an effect where a tone of an acoustic piano itself and a color, such as that of a string instrument, compatible with the piano tone mix together (strong tone mode) | mode for enjoying a performance with a non-piano color while obtaining natural sound field feeling and string resonance effect (weak tone mode) |

Further, the grand piano 1 can operate in a user-instructed performance mode of a plurality of performance modes. Examples of such a performance modes include a normal performance mode in which a tone is generated in response to a user's performance operation, and an automatic performance mode in which a tone is generated by automatic driving of a key. In order to carry out the present invention, it just suffices that the grand piano 1 be constructed to realize at least one of the performance modes.

[Construction of the Grand Piano 1]

Figure 2:
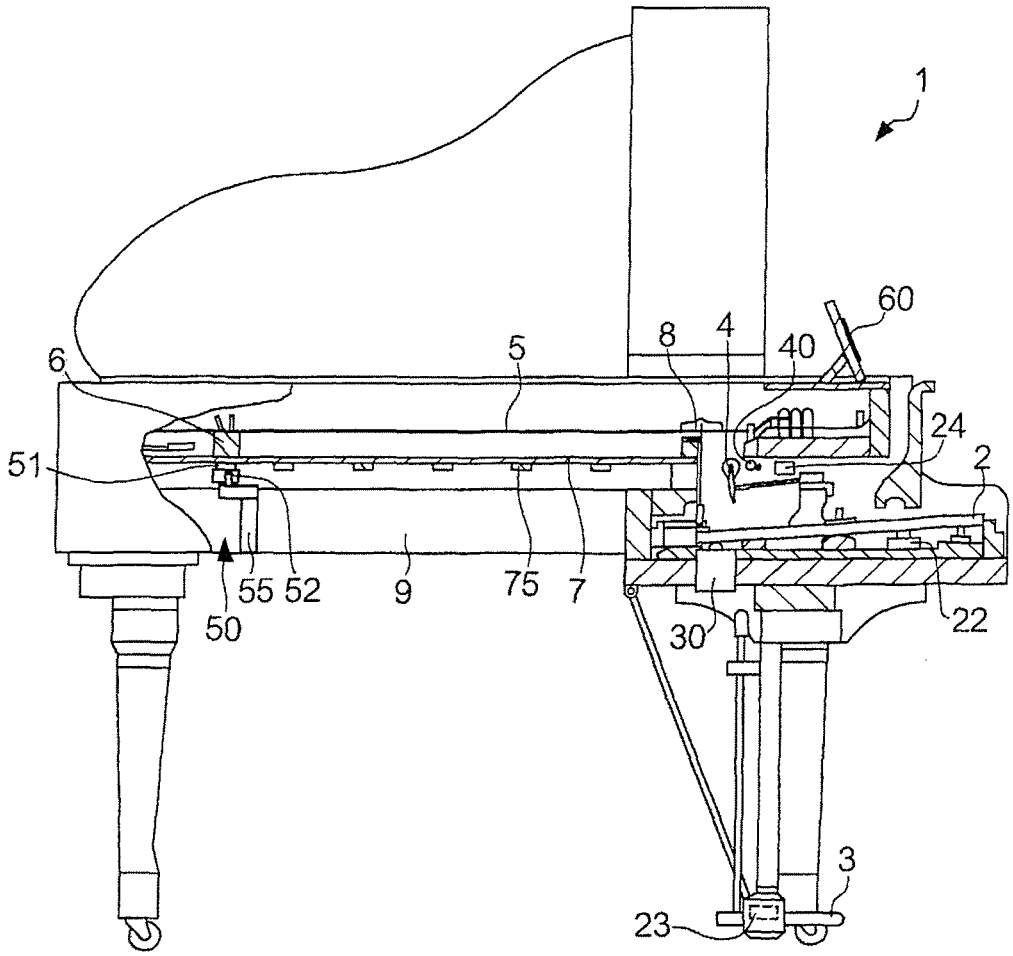
FIG. 2 is a view explanatory of an internal construction of the grand piano.

FIG. 2 is a view explanatory of an internal construction of the grand piano 1, where, for structural components provided in corresponding relation to the individual keys 2, only the structural components for one of the keys 2 are illustrated with illustration of the structural components for the other keys 2 omitted.

Underneath a rear end portion (i.e., an end portion remote from a user performing the grand piano 1) of each of the keys 2 is provided a key drive section 30 that drives the key 2 by use of a solenoid when the performance mode is the automatic performance mode. The key drive section 30 drives the solenoid in accordance with a control signal given from the control device 10. Namely, the drive section 30 reproduces the same state as when the user has depressed the key by driving the solenoid to cause the plunger to ascend and reproduces the same state as when the user has released the key by causing the plunger to descend. Namely, the difference between the normal performance mode and the automatic performance mode is whether the key 2 is driven by a user's operation or by the key drive section 30.

Hammers 4 are provided in corresponding relation to the keys 2, so that, when any one of the keys 2 has been depressed, the corresponding hammer 2 moves in response to force being transmitted to the hammer 2 via an action mechanism (not shown) and thereby strikes a string set (tone generating member) 5 corresponding to the depressed key 2. A damper 8 is brought out of or into contact with the string set 5 in accordance with a depressed amount of the key 2 and a depressed amount of a damper pedal of the pedals 3 (hereinafter, "pedal 3" refers to the damper pedal unless specified otherwise). When in contact with the string set 5, the damper 8 suppresses vibration of the string set 5.

A key sensor 22 is provided underneath the corresponding key 2 for outputting to the control device 10 a detection signal corresponding to behavior of the key 2. In the illustrated example, the key sensor 22 detects a depressed amount of the key 2 and outputs to the control device 10 a detection signal indicative of a result of the detection. Note that, whereas the key sensor 22 has been described above as outputting a detection signal corresponding to a depressed amount of the key 2, it may output a detection signal indicating that the key 2 has passed through a particular depressed position. The "particular depressed position" is any one, or preferably more, of positions from a rest position to an end position of the key 2. Namely, the detection signal output from the key sensor 22 may be any form of signal as long as the control device 10 is allowed to identify behavior of the key 2 on the basis of the detection signal.

Hammer sensors 24 are provided in corresponding relation to the hammers 4, and each of the hammer sensors 24 outputs to the control device 10 a detection signal corresponding to behavior of the corresponding hammer 4. In the illustrated example, each of the hammer sensors 24 detects a moving velocity of the hammer 4 immediately before the hammer 4 strikes the string set 5 and outputs to the control device 10 a detection signal indicative of a result of the detection. Note that the detection signal need not necessarily be indicative of a moving velocity itself of the hammer 4 and may be another form of detection signal as long as the control device 10 can calculate a moving velocity of the hammer 4 on the basis of the detection signal. For example, a detection signal indicating that the hammer shank has passed two predetermined positions during movement of the hammer 4 may be output, or a detection signal indicative of a time length from a time point when the hammer shank has passed through one of the two positions to a time point when the hammer shank has passed through the other of the two positions. Namely, the detection signal output from the hammer sensor 24 may be any form of detection signal as long as the control device 10 is allowed to identify behavior of the hammer 4 on the basis of the detection signal.

Pedal sensors 23 are provided in corresponding relation to the pedals 3, and each of the pedal sensors 23 outputs to the control device 10 a detection signal indicative of behavior of the corresponding pedal 3. In the illustrated example, the pedal sensor 23 detects a depressed amount of the corresponding pedal 3 and outputs to the control device 10 a detection signal indicative of a result of the detection. Whereas the pedal sensor 23 has been described as outputting a detection signal corresponding to a depressed amount of the pedal 3, the pedal sensor 23 may output a detection signal indicating that the pedal 3 has passed through a particular depressed position of the pedal 3. The "particular depressed position" is any of positions within a range from a rest position to an end position of the pedal and preferably a depressed position that permits distinction between a state where the dampers 8 and the string sets 5 are in complete contact with each other and a state where the dampers 8 and the string sets 5 are out of contact with each other. It is even further desirable that a plurality of such particular depressed positions be employed so that a half pedal state too can be detected. Namely, the detection signal output from the pedal sensor 23 may be any form of detection signal as long as the control device 10 is allowed to identify behavior of the pedal 3 on the basis of the detection signal.

The key sensor 22, the pedal sensor 23 and the hammer sensor 24 may output results of detection of the corresponding key 2, pedal 3 and hammer 4 as other forms of detection signals as long as the control device 10 is allowed to identify, for each of the keys 2 (key numbers), a time of striking by the hammer 4 of the corresponding string set 5 (key-on time), a velocity of the striking by the hammer 4 of the corresponding string set 5 and a time of suppression by the damper 8 of vibration of the corresponding string set 5 on the basis of the detection signals output from the key sensor 22, the pedal sensor 23 and the hammer sensor 24.

The sound board 7 is a plate-shaped member formed of wood. The sound board 7 has bridges 6 on its front face, and a plurality of sound board ribs (second rod-shaped members) 75 on its reverse face. In a normal piano performance, vibration of the string set 5 struck by the hammer 4 is transmitted via the bridge 6 to the sound board 7.

Further, a vibration device (actuator) 50 is mounted on the sound board 7. The vibration device 50 includes a vibration member 51 connected to the sound board 7, and a magnetic circuit member (magnetic path formation section) 52 supported by a support section 55. The support section 55 is formed of non-magnetic metal, such as aluminum material, suited for supporting the magnetic circuit member 52. Further, the support section 55 is fixed to a vertical strut 9 with a strength great enough to support a load of the magnetic circuit member 52. The vertical strut 9 is a plate-shaped member which is a part of a casing supporting a weight of the grand piano 1. A drive signal can be supplied or input from the control device 10 to the vibration device 50. The vibration member 51 of the vibration device 50 vibrates, in accordance with a waveform indicated by the input drive signal, to thereby vibrate the sound board 7, so that the bridge 6 too is vibrated. Namely, the vibration device 50 is an actuator for vibrating the sound board 7 and the bridge 6.

Figure 3:
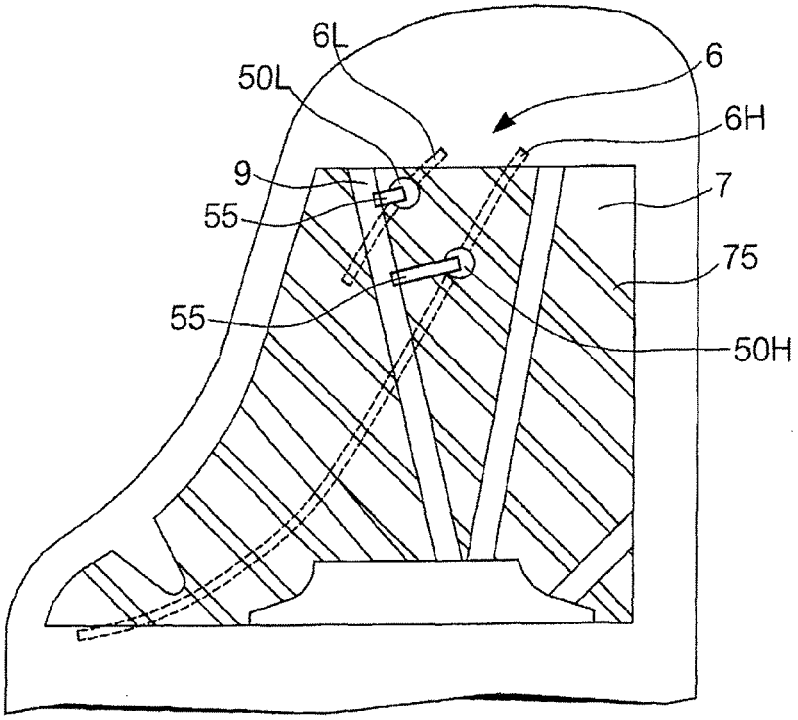
FIG. 3 is a view explanatory of a configuration of a vibration device.

FIG. 3 is a view explanatory of a configuration of the vibration device 50. In the illustrated example, two vibration devices 50H and 50L are provided as the vibration device 50. In the following description, the vibration devices 50H and 50L will be collectively referred to simply as "vibration device 50" when the vibration devices 50H and 50L need not be particularly described distinctively from each other. In the illustrated example, the vibration devices 50H and 50L are connected to the reverse face of the sound board 7 between two adjoining ones of the sound board ribs 75. The vibration device 50H is disposed at a position corresponding to the long bridge 6H of the two bridges (long and short bridges 6H and 6L), and the other vibration device 50L is disposed at a position corresponding to the short bridge 6L. Namely, the sound board 7 is sandwiched between the vibration devices 50H. 50L and the bridges 6H. 6L.

Note that the mounting position of the vibration device 50 is not limited to underneath the bridge. Namely, the sound board 7 may be mounted at any desired position, without necessarily being sandwiched between the vibration devices and the bridges, as long as the vibration device 50 is positioned in such a manner as to be capable of driving the sound board 7 by a necessary amount singly or in combination of a plurality of the vibration devices. Further, the number of the vibration devices 50 mounted on the sound board 7 is not necessarily limited to two and may be more or less than two. If only one vibration device 50 is mounted, it is desirable that the one vibration device 50 be disposed at a position corresponding to the long bridge 6H. The long bridge 6H is a bridge supporting the string sets 5 belonging to a high pitch range, while the short bridge 6L is a bridge supporting the string sets 5 belonging to a low pitch range. In the following description, the long and short bridges 6H and 6L will be collectively referred to simply as "bridge 6" when the bridges 6H and 6L need not be particularly described distinctively from each other.

[First Embodiment of the Vibration Device]

Figure 4:
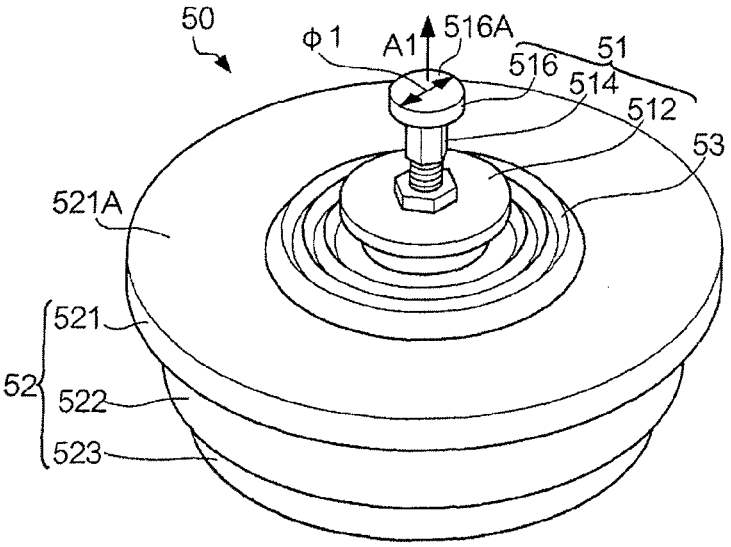
FIG. 4 is a view showing an outer appearance of a first embodiment of the vibration device of the present invention.

FIG. 4 is a view showing an outer appearance of a first embodiment of the vibration device 50 of the present invention. The vibration device 50 includes the vibration member 51, the magnetic circuit member 52 and a damper 53. The vibration member 51 includes: a voice coil 513 attached to a bobbin 511; a cap 512 connected to a distal end portion of the bobbin 511; a shaft 514; and a spacer 516. The cap 512 is a disk-shaped member. The shaft 514 is a rod-shaped member and has one longitudinal end portion fixed to the center of the circular surface of the cap 512, and the spacer 516 is mounted on another longitudinal end portion of the shaft 514. The spacer 516 is a member of a circular columnar shape and has a flat end surface opposite from its end portion mounted on the shaft 514. The flat end surface, which has a circular shape having a diameter $\phi$, is a surface to be connected to the sound board 7. In the following description, a direction along a normal line to the flat end surface of the spacer 516 will be referred to as "normal line direction A1", and let it be assumed here that a positive direction of the normal line direction A1 is a direction in which the flat end surface is oriented. Further, in each of figures to be described hereinbelow, a positive direction side, in the normal line direction A1, of the vibration device 50 is assumed to be an upper side, while a negative direction side, in the normal line direction A1, of the vibration device 50 is assumed to be a lower side. Further, surfaces oriented in the upper side direction will be referred to as upper surfaces, while surfaces oriented in the lower side direction will be referred to as lower surfaces. The aforementioned flat end surface of the spacer 516 will be referred to as "upper surface 516A".

The magnetic circuit member 52 includes a top plate 521, a magnet 522 and a yoke 523, and these elements 521, 522 and 523 are vertically superposed on one another from above in the order they were mentioned here. Namely, in the magnetic circuit member 52, the top plate 521 is located uppermost, and the yoke 523 is located lowermost. The damper 53 is a member formed of fibers or the like in a disk shape, and it has an accordion-like wavy shape (such an accordion-like wavy shape is shown in a simplified manner in FIG. 4). The damper 53 has an outer peripheral end portion mounted to the upper surface 521A of the top plate 521 and an inner peripheral end portion mounted to the vibration member 51, so that the damper 53 supports the vibration member 51 in such a manner that the vibration member 51 can vibrate in the normal line direction A1. The vibration device 50 vibrates the sound board 7 by vibrating the vibration member 51 in the normal line direction A1.

Figure 5:
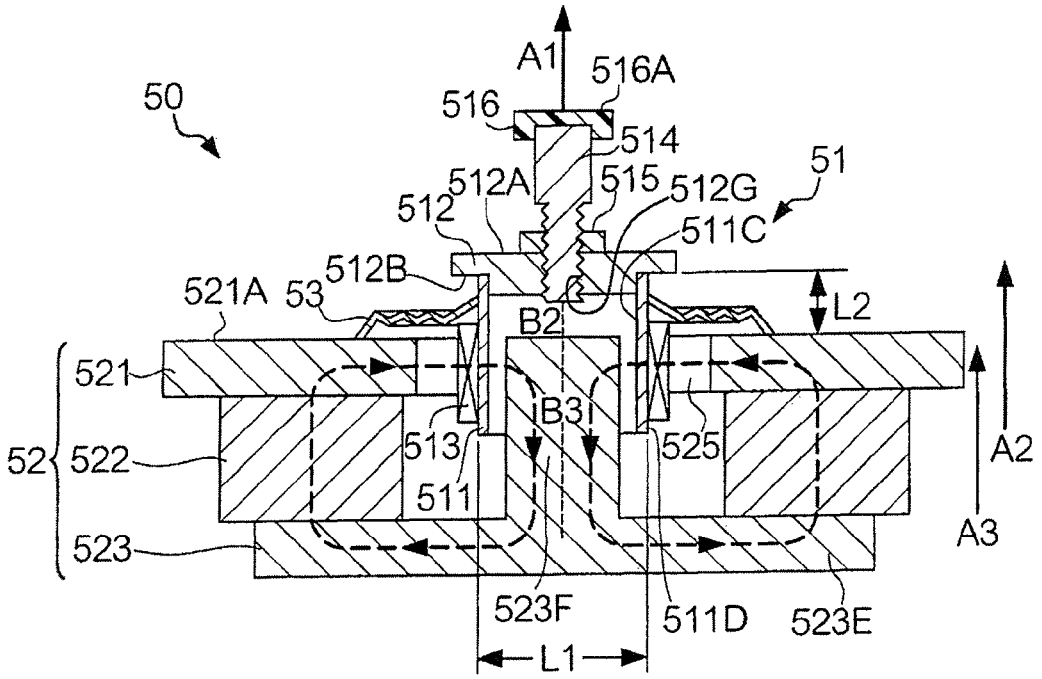
FIG. 5 is a vertical sectional view of the vibration device shown in FIG. 4.

FIG. 5 is a vertical sectional view of the vibration device 50 shown in FIG. 4. The vibration member 51 includes the bobbin 511, the cap 512, the voice coil 513, the shaft 514, a nut 515 and the spacer 516. The bobbin 511 is a cylindrical member of an outer diameter L1 formed of non-magnetic metal, such as aluminum material. Opposite end portions, in an axial direction A2, of the bobbin 511 are open. The axial direction A2 is a direction along an axis line B2 of the cylindrical shape of the bobbin 511, and a positive direction of the axial direction A2 is a lower-to-upper direction. The voice coil 513 is provided on and around the outer peripheral surface 511D and transforms an electric current into vibration, and the voice coil 513 is formed of a conductive wire wound around the outer peripheral surface 511D.

The cap 512, which is a member formed of non-magnetic metal having a high thermal conductivity, such as aluminum material, is connected to an upper end open portion, in the axial direction A2, of the bobbin 511 to thereby close the upper open end portion of the bobbin 511. As shown in FIG. 4, the cap 512, which has a disk shape as a whole, includes an upper, large disk-shaped portion (upper side portion) and a lower, small disk-shaped portion (lower side portion). An outer diameter of the lower side portion equals an inner diameter of the bobbin 511, so that the lower side portion is fitted in the bobbin 511. Further, the upper side portion of the cap 512 is engaged by an end portion of the bobbin 511 so that the cap 512 does not enter deep into the bobbin 511. The underside 512B of an outer peripheral region of the upper side portion of the cap 512 contacts the end portion of the bobbin 511. The underside 512B protrudes laterally outward beyond the outer periphery of the bobbin 511. Further, the cap 512 has a hole portion 512G ending centrally through the upper side portion and the lower side portion. A female thread (internal thread) is formed in the hole portion 512G.

The shaft 514 is a member formed of metal, such as aluminum material, in a rod shape and extending in the axial direction A2. A male thread (external thread) is formed on a more-than-half portion, in a longitudinal direction, of the shaft 514 in such a manner that it is meshingly engageable with the female (internal) thread of the hole portion 512G. The male (external) thread continuously extends to one end portion, in the longitudinal direction, of the shaft 514. Another end portion of the shaft 514 has a hexagonal columnar shape like a so-called bolt head shape (see FIG. 4), and the hexagonal columnar portion is turnable or rotatable with a spanner wrench or the like. By the hexagonal columnar portion being rotated like this, the shaft 514 moves relative to the cap 512 in the axial direction A2 within a predetermined range. The "predetermined range" is, for example, from a position of the shaft 514 moved upward until the lower end of the shaft 514 aligns with the lower end of the hole portion 512G (such a position will be referred to as "upper limit position") to a position of the shaft 514 moved downward until the hexagonal columnar portion cannot rotate any more (such a position will be referred to as "lower limit position"). This predetermined range will hereinafter be referred to as "shaft moving range".

The nut 515 has a female thread formed therein and meshingly engageable with the male thread of the shaft 514. The nut 515 is fitted over a portion of the shaft 514 closer to the hexagonal columnar portion than the cap 512. As the nut 515 is pressed against the cap 512 by being rotated with a spanner wrench or the like, the shaft 514 is fixed with respect to the cap 512. The spacer 516 is a member fixed to an upper end portion, in the axial direction A2, of the shaft 514 and sandwiched between the shaft 514 and the sound board 7. The spacer 516 is formed of synthetic resin or the like and has a lower thermal conductivity than the shaft 514 and cap 512 formed of aluminum material. The above-mentioned upper surface 516A is the upper surface of the spacer 516 opposite from the upper side of the spacer 516, i.e. the side of the spacer 516 fixed to the shaft 514.

With the various portions of the vibration member 51 joined to one another in the aforementioned manner, the normal line direction A1 of the upper surface 516A matches the axial direction A2 of the bobbin 511. The upper surface 516A of the spacer 516 constitutes an upper end of the vibration member 51 to be connected to the sound board 7 (such an upper end will hereinafter be referred to as "connection end"); namely, the spacer 516 is an end member forming such a connection end. A distance between the connection end and the bobbin 511 constitutes a predetermined range, i.e. a range within which the distance between the connection end and the bobbin 511 varies as the connection end moves in response to the shaft 514 moving within the above-mentioned shaft moving range. Such a range will hereinafter be referred to as "end moving range". Further, a combination of the cap 512, the shaft 514, the nut 515 and the spacer 516 coupled to one another in the aforementioned manner functions as a connection member for connecting the bobbin 511 to the sound board 7 with an overall length (i.e., length from the upper end of the bobbin 511 to the connection end 516A) adjusted as appropriate. In short, the connection member comprises the rod-shaped member (shaft 514), and a screw structure (a combination of the male thread of the shaft 514 and the female thread of the cap 512) for converting rotational displacement of the rod-shaped member (shaft 514) into linear displacement of the rod-shaped member (shaft 514).

Note that the term "length" is used herein to refer to a length, for example, in the axial direction A2. The connection member is fixed at the connection end to the sound board 7 with its overall length adjusted as appropriate while positioning the voice coil 513, provided on the bobbin 511, at a predetermined position within a magnetic path space 525 shown in FIG. 5. Positioning the voice coil 513 at the predetermined position within the magnetic path space 525 means, in other words, placing the voice coil 513 and the top plate 521 in predetermined positional relationship, e.g. in mutually-opposed relationship.

The top plate 521 is formed, for example, of soft magnetic material, such as soft iron, in a disk shape having a central hole (i.e., in a ring shape). Further, the yoke 523 is formed, for example, of soft magnetic material, such as soft iron, in such a shape that a disk portion 523E of a disk shape and a circular columnar portion 523F, having a smaller outer diameter than the disk portion 523E, are formed concentrically with each other. The outer diameter of the circular columnar portion 523F is smaller than the inner diameter of the top plate 521. The magnet 522 is a ring-shaped permanent magnet, and it has a smaller inner diameter than the top plate 521.

The top plate 521, the magnet 522 and the yoke 523 are superposed on one another in substantial axis alignment (i.e., with their respective axis lines substantially coinciding with one another) in the order they were mentioned such that the top plate 521 is located uppermost. A height of the circular columnar portion 523F from the disk portion 523E, i.e. a dimension, in an axial direction A3, of the circular columnar portion 523F, is substantially equal to a sum of respective dimensions, in the axial direction A3, of the top plate 521 and the magnet 522. The axial direction A3 is a direction along the axis line B3 of the circular column of the circular columnar portion 523F, and let it be assumed here that a down-to-up direction of the axial direction A3 is a positive direction of the axial direction A3. The top plate 521, the magnet 522 and the yoke 523 arranged in the aforementioned manner form a magnetic path indicated by broken-line arrows in FIG. 5. The vibration member 51 is supported by the damper 53 in such a manner that the voice coil 513 is positioned in a magnetic path space 525 which is sandwiched between the top plate 521 and the circular columnar portion 523F and in which the magnetic path is formed. The top plate 521, the magnet 522 and the yoke 523 cooperate with one another to function as a magnetic path formation means for forming the magnetic path space 525. A drive signal input to the vibration device 50 is input to the voice coil 513. In response to receipt of the magnetic force in the magnetic path space 525, drive force is generated such that the bobbin 511 moves and vibrates in the axial direction A2 in accordance with a waveform indicated by the input drive signal. Namely, the vibration member 51 is a vibration means that vibrates in the axial direction A2 in accordance with the drive signal input to the voice coil 513. Further, the vibration device 50 is a voice coil type actuator that imparts vibration to the sound board by the drive force generated in the voice coil 513.

The voice 513 has a dimension in the axial direction A2 (hereinafter referred to as "coil length dimension") greater than a dimension in the axial direction A2 of the magnetic path space 525 (hereinafter referred to as "magnetic path width dimension"). Further, the less variation in the number of coil winding turns present in the magnetic path space 525 when the vibration member 513 is vibrating (during vibration of the vibration member 513), the more stable drive force can the voice coil 513 generate. Conversely, as variation in the number of coil winding turns present in the magnetic path space 525 during vibration of the vibration member 513 increases, the drive force generated by the voice coil 513 varies more, so that desired vibration (amplitude in particular) cannot be obtained. For example, once there occurs a state where an end portion, in the axial direction A2, of the voice coil 513 (hereinafter referred to as "coil end portion") has entered the magnetic path space 525 during the vibration of the vibration member 513, in other words, once there occurs a state where the magnetic path space 525 has protruded out beyond the voice coil 513, the number of turns varies so greatly that desired vibration cannot be obtained and thus a desired tone cannot be generated. The more the middle, in the axial direction A2 (length direction), of the voice coil 513 (hereinafter referred to as "coil length middle") is deviated from the middle, in the axial direction A2 (length direction), of the magnetic path space 525 (hereinafter referred to as "magnetic path width middle") when the vibration member 51 is not vibrating, the more one coil end portion of the voice coil 513 approaches the magnetic path space 525, so that it becomes more likely for the aforementioned states to occur during vibration of the vibration member 51. Conversely, if the above-mentioned coil length middle and the magnetic path width middle coincide with each other, it becomes least likely for the aforementioned states to occur, so that a desired tone can be obtained in the most stable manner. In the illustrated example of FIG. 5, the vibration member 51 and the magnetic circuit member 52 are positioned in such a manner that the above-mentioned coil length middle and the magnetic path width middle coincide align with each other, and a height from the top plate 521 (i.e., the upper surface 521A) to the upper end of the bobbin 511 is depicted as L2.

By increasing the coil length dimension, the aforementioned phenomena can also be made less likely to occur. Further, if the coil length dimension is increased, it becomes less likely for the coil end portion to enter the magnetic path space 525 even where the coil length middle and the magnetic path width middle are deviated from each other. However, if the number of coil winding turns per unit length is not changed, inductance of the voice coil 513 increases as the coil length dimension is increased, so that frequencies at which good responsiveness can be obtained would be limited to low frequencies. Therefore, it is desirable that the coil length dimension be equal to a sum of the magnetic path width middle and a maximum amplitude of vibration of the vibration member 51 or such a sum plus a length of play; in the illustrated example, the coil length dimension of the voice coil 513 is set to equal the latter sum (i.e., sum of the magnetic path width middle, the maximum amplitude of vibration of the vibration member and the length of play. Therefore, it is necessary that the vibration member 51 and the magnetic circuit member 52 be mounted accurately so that their relative positions in the axial direction A2 have predetermined relationship. Here, the predetermined relationship means that the vibration member 51 and the magnetic circuit member 52 are positioned relative to each other such that the coil length middle and the magnetic path width middle coincide with each other.

Note that, although the coil length dimension is greater than the magnetic path width dimension in the instant embodiment, the coil length dimension may be smaller than the magnetic path width dimension. Even in that case, it becomes least likely for the coil end portion to protrude out beyond the magnetic path space 525 during vibration of the vibration member 51 and least likely for the aforementioned phenomena to occur.

Further, in FIG. 5, the bobbin 511 is supported by the damper 53 in such a manner that the axis line B2 of the bobbin 511 aligns with (substantially coincides with) the axis line B3 of the circular columnar portion 523F. Such a state is referred to as a state where the axes of the bobbin 511 and the circular columnar portion 523F align with each other, in other words, a state where the bobbin 511 and the circular columnar portion 523F are in axis alignment with each other. When the bobbin 511 and the circular columnar portion 523F are in axis alignment with each other like this, the bobbin 511 is less likely to contact the circular columnar portion 523F as compared to when the bobbin 511 and the circular columnar portion 523F are not in axis alignment with each other, i.e. when a portion of the inner peripheral surface 511C of the bobbin 511 is located closer to the circular columnar portion 523F than the remaining portion of the inner peripheral surface 511C.

Because the top plate 521, magnet 522 and yoke 523 of the magnetic circuit member 52 are formed of soft magnetic material or magnet as noted above and greater in volume than the vibration member 51, they are much heavier than the vibration member 51 formed of resin or aluminum material. Further, because the load of the magnetic circuit member 52 acts on the vertical strut 9 via the support section 55, most of the load of the vibration device 50 is prevented from acting on the sound board 7. Although the load of the vibration member 51 acts on the sound board 7, such a load acting on the sound board 7 is nominal, an influence of the load on a vibration characteristic of the sound board 7 can be minimized.

Next, with reference to FIGS. 6 to 11, a description will be given about a sequence of operations performed when a human operator attaches the vibration device 50 to the grand piano 1.

Figure 6:
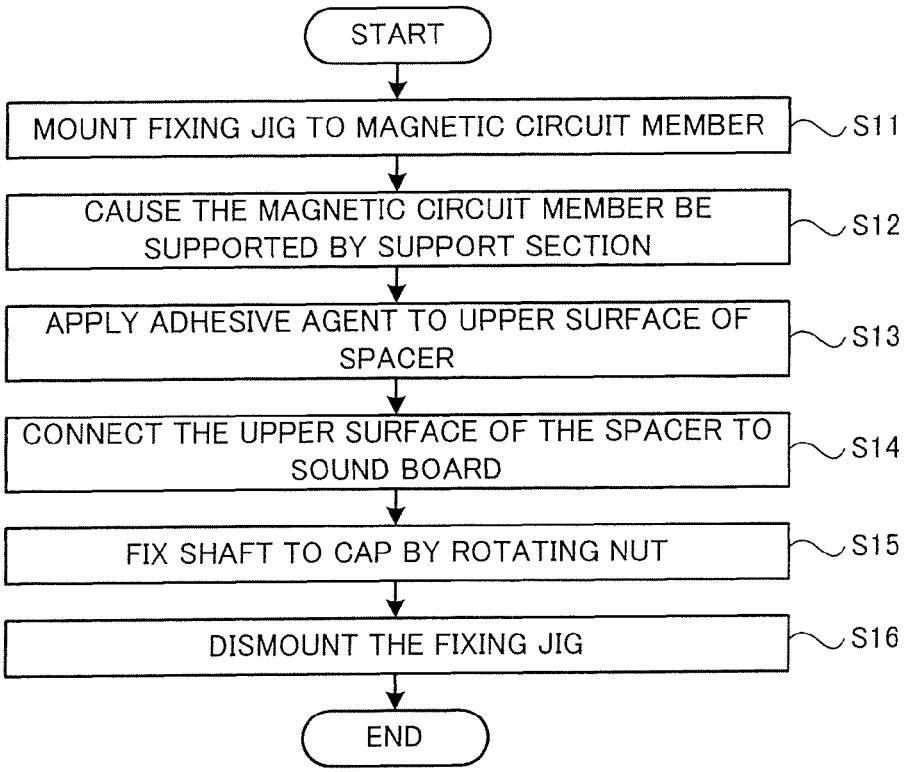
FIG. 6 is a flow chart showing a sequence of operations for attaching the vibration device to the grand piano.

FIG. 6 is a flow chart showing the sequence of operations for attaching the vibration device 50 to the grand piano 1.

First, the grand piano 1 to which the vibration device (actuator) 50 has not been attached yet is provided. Then, the support section 55 is mounted on a predetermined portion, such as the vertical strut 9, of the grand piano 1. In this case, a position of the support section 55 is determined properly in association with a predetermined actuator-attaching position of the sound board 7 to which the vibration device (actuator) 50 is to be attached. The sequence of operations shown in FIG. 6 is started up with the support section 55 connected to the vertical strut 9. Then, the human operator mounts a predetermined fixing jig to the magnetic circuit member 52 (step S11). Here, the fixing jig is a reference position instructing member (jig) for automatically indicating that the relative positions, in the axial direction A2, of the vibration member 51 and the magnetic circuit member 52 are in the above-mentioned desired relationship (i.e., ideal position or reference mounted position of the voice coil within the magnetic path space).

Figure 7:
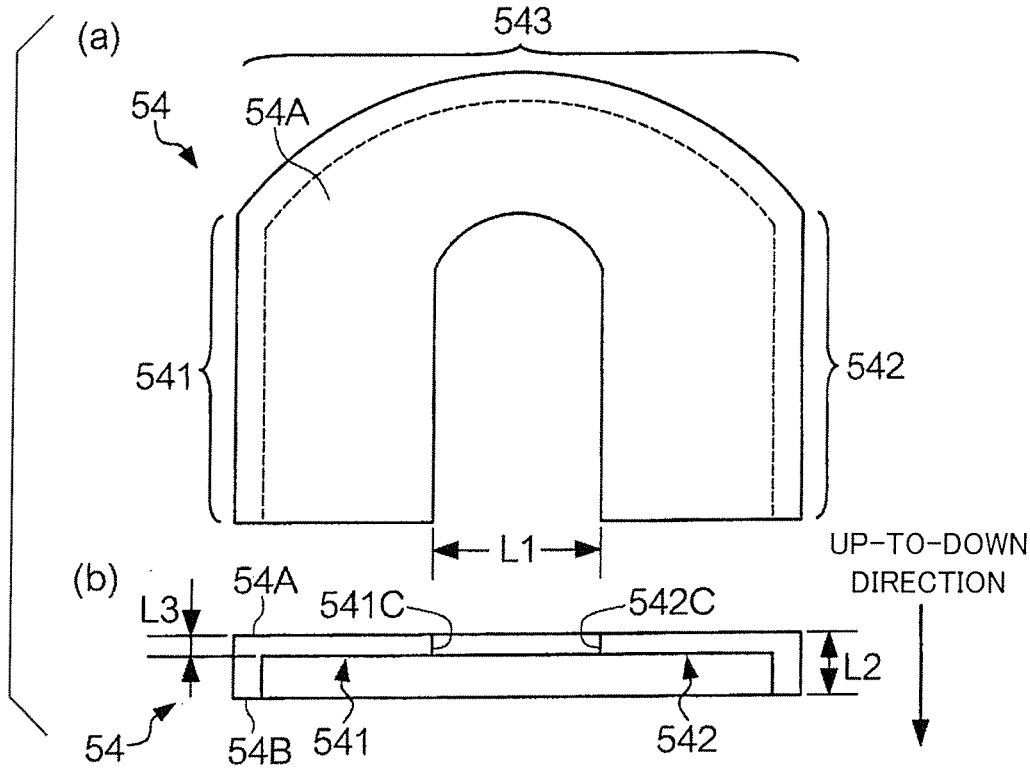
FIG. 7 is a plan view and a front view showing an outer appearance of a fixing jig.

FIG. 7 is a view showing an outer appearance of the fixing jig 54 that is formed of magnetic material, such as iron, in a plate shape. (a) of FIG. 7 is a plan view showing the fixing jig 54 as viewed from a side of the upper surface 54A that is the largest of all of the surfaces of the fixing jig 54. In the fixing jig 54, a side the upper surface 54A faces is assumed to be an upper side. Further, in (a) of FIG. 7, the fixing jig 54 has a shape of a letter U, which has two straight portions 541 and 542 and a curve portion 543 connecting between respective one ends of the two straight portions 541 and 542. Respective distal end portions of the straight portions 541 and 542 are spaced from each other by a distance L1 to define an inner space therebetween.

(b) of FIG. 7 is a front view of the fixing jig 54. In the fixing jig 54, a side where the respective distal end portions of the straight portions 541 and 542 are visible, i.e. where the inner space of a U shape is visible, will be referred to as "front side", a side opposite from that front side will be referred to as "back side", and a side where a side surface of any one of the straight portions 541 and 542 is visible will be referred to as "side surface". Further, for convenience of the following description, a side where the inner space interposed between the straight portions 541 and 542 is located will be referred to as "inner side", and a side opposite from the inner space across any one of the straight portions 541 and 542 from the inner space will be referred to as "outer side". Further, the side the upper surface 54A faces will be referred to as "upper side" as noted above, and a side opposite from the upper side will be referred to as "lower side". Further, a direction from the upper side to the lower side will be referred to as "up-down direction". Further, the fixing jig 54 has its lower surface 54B that is located in a portion opposite from the upper surface 54A and closest to the outer side. In the illustrated example of (a) of FIG. 7, the lower surface 54B is located opposite from an outermost region of the upper surface 54A outside a broken line (hidden line). A distance between the upper surface 54A and the lower surface 54B, i.e. a thickness, in the up-down direction, of the outermost region of the fixing jig 54, is depicted as L2. This thickness L2 is equal to the height from the upper surface 521A of the top plate 521 to the upper end of the bobbin 511 when the above-mentioned coil length middle and magnetic path width middle are coincident with each other. Further, the fixing jig 54 has a thickness L3 (in the up-down direction), smaller than the thickness L2, in its region inside the lower surface 54B (L3<L2), so that a space is defined between the lower surface 54B and the lower surface of the small-thickness region. The straight portions 541 and 542 have inner side surfaces 541C and 542C, respectively, extending in the up-down direction. The inner side surfaces 541C and 542C are opposed to each other and each define a corner with the upper surface 54A.

Figure 8:
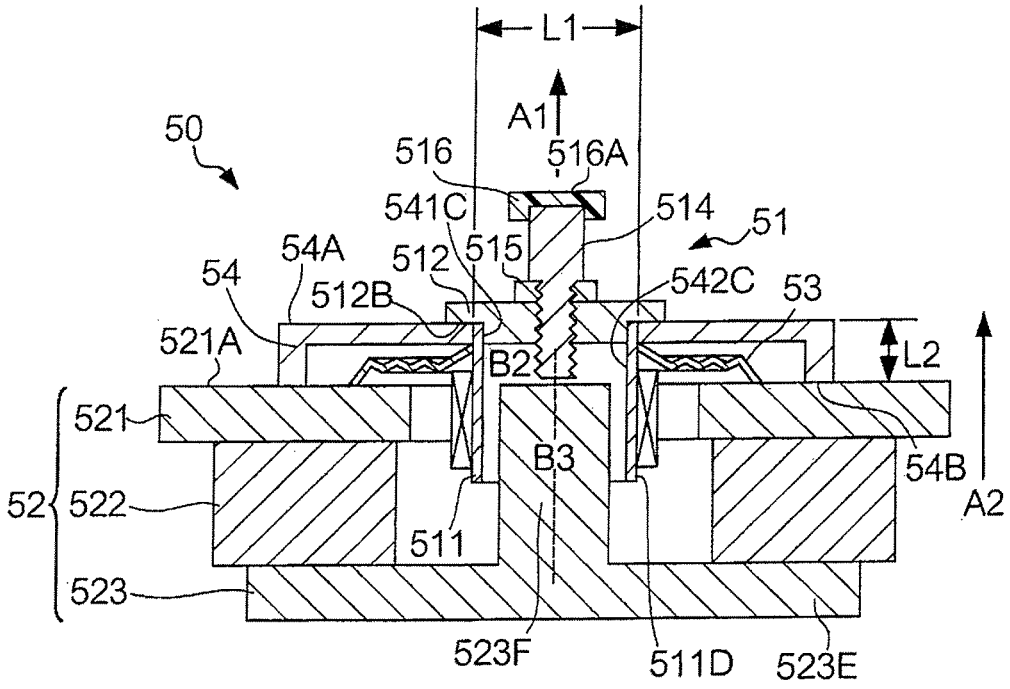
FIG. 8 is a view showing the fixing jig mounted to a magnetic circuit member.

FIG. 8 is a view showing a state where a position and orientation of the vibration member 51 relative to the magnetic circuit member 52 are restricted by means of the fixing jig 54. In FIG. 8, the shaft 514 has been lowered, with the nut 515 fittingly engaging with the root of the male thread portion of the shaft 514, to a position immediately before the lower surface of the nut 515 contacts the upper surface of the cap 512. Note, however, that the shaft 514 may be lowered until the lower surface of the nut 515 contacts the upper surface of the cap 512. The fixing jig 54 is installed with the lower surface 54B placed in contact with the upper surface 521A of the top plate 521. Because the fixing jig 54 is formed of magnetic material as noted above, it is fixed to the upper surface 521A by magnetic attractive force of the top plate 521 magnetized by the magnetic force of the magnet 522. Then, the fixing jig 54 is mounted in place so as to sandwich the bobbin 511 between the straight portions 541 and 542 (i.e., to accommodate the bobbin 511 in the U-shaped inner space of the jig 54). Because the outer diameter of the bobbin 511 and the distance between the straight portions 541 and 542 are both L1 as noted above, the outer peripheral surface 511D of the bobbin 511 are placed in contact with the side surfaces 541C and 542C. Thus, the bobbin 511 does not move in any other direction than the direction along the side surfaces 541C and 542C, unless force capable of moving in that other direction the fixing jig 54 fixed to the upper surface 521A by the magnetic attractive force as noted above is applied to the fixing jig 54. At that time, it is desirable that the fixing jig 54 be mounted such that the axis line B2 of the bobbin 511 and the axis line B3 of the circular columnar portion 523F align (substantially coincide) with each other as in the state shown in FIG. 5.

Further, although the bobbin 511 is supported by the damper 53 in such a manner that it can vibrate in the normal line direction A1, it is prevented from moving more downward than the position where the lower surface 512B of the cap 512 contacts the upper surface 54A of the fixing jig 54. When these surfaces are in contact with each other, the distance between the upper end of the bobbin 511 and the upper surface 521A of the top plate 521 equals the distance between the upper and lower surfaces 54A and 54B of the fixing jig 54, i.e. the thickness L2 of the fixing jig 54, and thus, the above-mentioned coil length middle and the magnetic path width middle substantially coincide with each other as noted above. Namely, because a range over which the vibration member 51 can move downward is limited by the fixing jig 54, the relative positions, in the axial direction A2, of the vibration member 51 and the magnetic circuit member 52 can be maintained in the above-mentioned desired relationship.

Referring back to FIG. 6, the human operator causes the magnetic circuit member 52 to be supported by the support section 55 (i.e., installs the magnetic circuit member 52 on the support section 55) (step S12). At that time, the human operator causes the magnetic circuit member 52 to be supported by the support section 55 after securing a height position of the magnetic circuit member 52 such that a distance from the magnetic circuit member 52 to the sound board 7 falls within the abovementioned end moving range. For example, in a case where the magnetic circuit member 52 is mounted above the support section 55 via a plurality of support rods, a height of the magnetic circuit member 52 to be supported via the plurality of support rods is set properly. In other words, the human operator causes the magnetic circuit member 52 to be supported by the support section 55 at a proper height such that, with the overall length of the connection member adjusted as described later, the connection member can be connected at the connection end to the sound board 7. Also, the human operator causes the magnetic circuit member 52 to be supported by the support section 55 after determining a position of the support section 55 such that the vibration member 51 including the spacer 516 is opposed from below to a vibration area preset on the lower surface 7B of the vibration member 51. This vibration area is preset as an area for connecting the upper surface 516A of the spacer 516 to the sound board 7 and includes, for example, the position of the bridge 6H or bridge 6L shown in FIG. 3.

Figure 9:
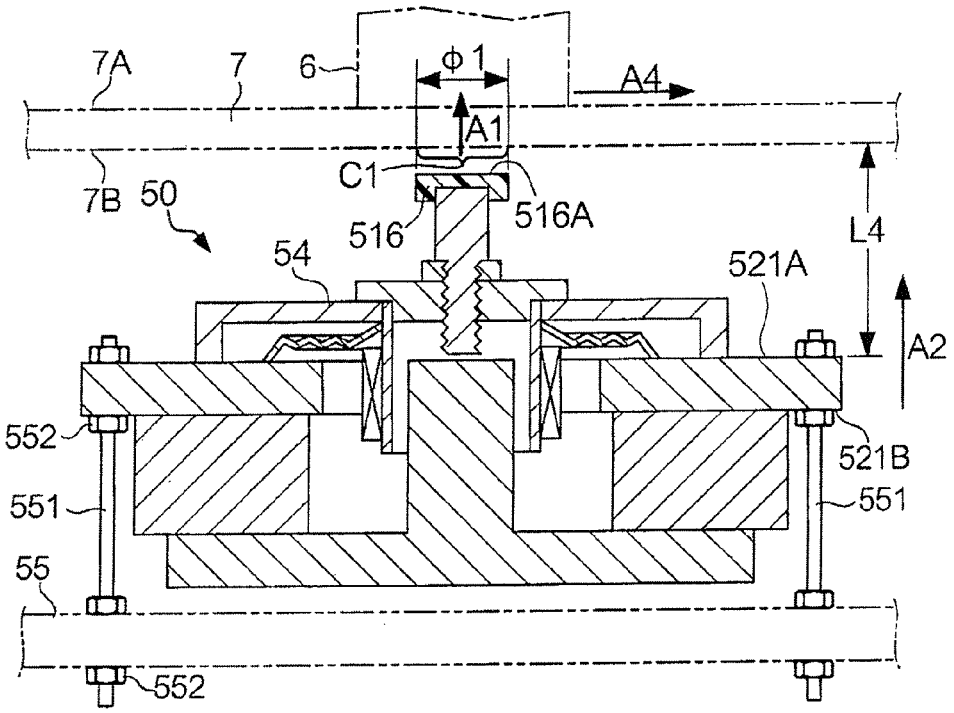
FIG. 9 is a view showing the magnetic circuit member supported by the support section.

FIG. 9 is a view showing the magnetic circuit member 52 supported by the support section 55 in the aforementioned manner. In FIG. 9, the positions of the sound board 7, bridge 6 and support section 55 are indicated by two-dot-dash lines in order to show positional relationship among the vibration device 50, the sound board 7, the bridge 6 and the support section 55. Further, in FIG. 9, the state where the magnetic circuit member 52 has been supported by the support section 55 is shown as viewed in such a direction where a width direction A4 of the bridge 6 corresponds to a left-right direction of the figure. The bridge 6 is mounted on the upper surface 7A of the sound board 7. Further, the vibration area C1 is preset on the lower surface 7B of the sound board 7. The vibration area C1 is an area to which force is applied from the vibration device 50 and which is set such that a middle, in the width direction A4, of the bridge 6 aligns with the normal line A1 passing centrally through the width of the bridge 6. Further, the vibration area C1 has a shape similar to that of the upper surface 516A of the spacer 516; more specifically, the vibration area C1 is a circular area whose dimension in the width direction A4 (i.e., diameter) is $\phi 1$.

The top plate 521 has a plurality of through-holes formed in predetermined positions thereof close to the outer periphery of the lower surface 521B. The support section 55 has a plurality of through-holes extending vertically therethrough in positions corresponding to the positions of the through-holes of the top plate 521. Each of the plurality of support rods 551 has male threads formed on opposite end portions thereof. Such opposite end portions having the male threads are inserted through corresponding ones of the through-holes of the top plate 521 and the support section 55 and fastened to the top plate 521 and the support section 55 by means of a plurality of nuts 552, so that the magnetic circuit member 52 is fixed to the support section 55 as shown in the figure. Note that a female thread may be formed in each of the through-holes. As noted above in relation to FIG. 3, the support section 55 is fixed to the vertical strut 9 with a strength great enough to support the load of the magnetic circuit member 52. Thus, the load of the magnetic circuit member 52 acts on the vertical strut 9 via the support section 55. Also, the magnetic circuit member 52 is supported by the support section 55 in such a manner that a distance L4 between the magnetic circuit member 52 and the sound board 7 falls within the aforementioned end moving range, i.e. a range where the distance between the connection end (upper surface 516A) and the bobbin 511 varies. Because the position in the normal line direction A1 or axial direction A2 (height position) of the magnetic circuit member 52 when supported by the support section 55 only has to be such that the distance L4 falls within the end moving range, no particular severe accuracy is required of the position of the magnetic circuit member 52. Thus, the human operator can perform step S12 with an increased ease as compared to the case where severe accuracy is required, e.g. where the position (height position) of the magnetic circuit member 52 should be matched with a predetermined position (height position) in the axial direction A2. The operation of step S12 is an example of a "support step" in the present invention.

Referring back to FIG. 6, the human operator then applies an adhesive agent to the upper surface 516A of the space 516 (step S13). The adhesive agent used here may be any desired adhesive, such as one capable of adhering wood and resin together, as long as it can adhere the sound board 7 and the spacer 516 together. Then, the human operator connects the upper surface 516A of the spacer 516 to the sound board 7 by rotating the shaft 514 with a spanner wrench or the like to thereby move the shaft 514 upward. At that time, the upper surface 516A can surely reach and connect to the sound board 7, because the distance L4 is set to fall within the end moving range as noted above. By such operations, the upper surface 516A having the adhesive agent applied thereto can be adhesively connected to the sound board 7. A series of the operations of steps S13 and S14 is an example of a "connection step" in the present invention.

Figure 10:
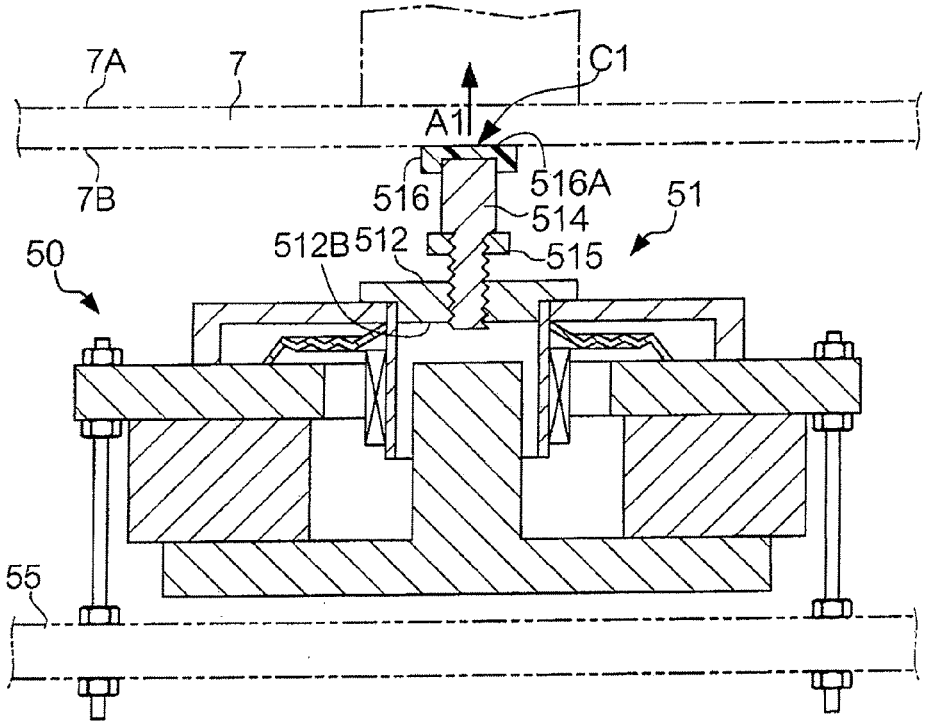
FIG. 10 is a view showing a spacer connected to a sound board.

FIG. 10 is a view showing the spacer 516 connected to the sound board 7. In FIG. 10, the shaft 514 has been moved upward from the position shown in FIG. 9, so that the upper surface 516A of the spacer 516 has been connected to the sound board 7. In FIG. 9, the upper surface 516A is located underneath and connects to the vibration area C1. At that time, the spacer 516 is pressed against the sound board 7. Further, the range over which the vibration member 51 can move downward is limited by the fixing jig 54 as noted above, and thus, even if force acts on the vibration member 51 in the negative direction of the normal line direction A1 due to reaction from the sound board 7, the position of the vibration member 51 relative to the magnetic circuit member 52 can be maintained appropriately such that the coil length middle and the magnetic path width middle coincide with each other.

Further, as noted above, the position of the shaft 514 moved upward until the lower end of the shaft 514 aligns with the lower end of the hole portion 512G is preset as the upper limit position. Thus, following the operation of step S14, the lower end of the shaft 514 aligns with the lower end, i.e. lower surface 512B, of the cap 512, or protrudes downward beyond the lower surface 512E of the cap 512 in the illustrated example of FIG. 10. Because the shaft moving range is set in the aforementioned manner, an axial length of a region of the shaft 514 supported by the hole portion 512G is large and thus the shaft 514 can be made less likely to incline in a direction, such as the width direction A4 of FIG. 9, intersecting the axial direction A2, as compared to a case where the lower end of the shaft 514 is located above the lower surface 512B of the cap 512.

Figure 11:
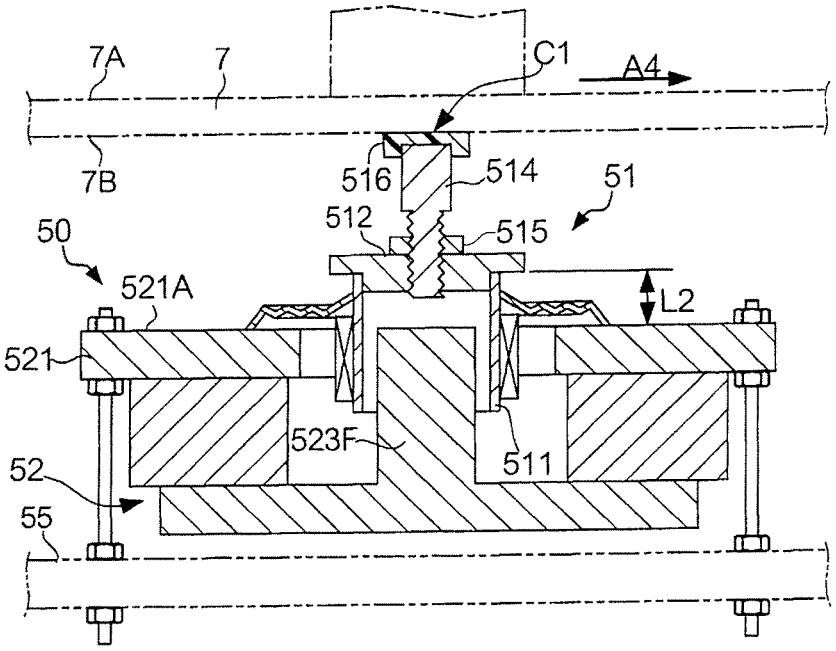
FIG. 11 is a view showing a shaft fixed to a cap.

Referring back to FIG. 6, the human operator then rotates the nut 515, for example, with a spanner wrench to move the nut 515 in the negative direction of the normal line direction A1. By moving downward the nut 515 until the nut 515 is pressed against the cap 512, the human operator fixes the shaft 514 to the cap 512 (step S15). By that operation, a length of the shaft 514 from the bobbin 511 to the upper surface 516A is fixed with the upper surface 516A connected to the sound board 7. The operation of step S15 is an example of a "fixation step" in the present invention. Finally, the human operator detaches or dismount the fixing jig 54 (step S16) and finishes the sequence of operations for attaching the vibration device 50 to the grand piano 1. With the vibration device 50 attached to the grand piano 1 in the aforementioned manner, the sound board 7 is pushed upward as the bobbin 511 moves in the positive direction of the normal line direction A1. But, as the bobbin 511 moves in the negative direction of the normal line direction A1, the sound board 7 is pulled downward by the bobbin 511 instead of the bobbin 511 being disconnected from the sound board 7. Thus, vibration of the bobbin 511 is imparted to the bridge 6 by way of the sound board 7 and then to the string set 5. FIG. 11 shows the vibration device 50 having been attached to the grand piano 1.

FIG. 11 is a view showing a state when the sequence of operations for attaching the vibration device 50 has been completed. In FIG. 11, the upper surface 516A of the spacer 516 has been connected to the vibration area C1 of the sound board 7, and the magnetic circuit member 52 has been supported by the support section 55. At that time, the relative positions, in the normal line direction A1, of the vibration member 51 and the magnetic circuit member 52 are in desired relationship such that the coil length middle and the magnetic path width middle coincide with each other. Thus, the vibration device 50 can be mounted with ease at a desired position in the normal line direction A1, i.e. in the direction where the vibration member 51 vibrates (vibrating direction of the vibration member 51). Further, if the fixing jig 54 was mounted with the axis line B2 of the bobbin 511 and the axis line B3 of the circular columnar portion 523F aligned with (substantially coinciding with) each other, and if such aligned state is maintained till completion of the operation of step S15, axis alignment between the bobbin 511 and the circular columnar portion 523F is achieved. Thus, in this case, contact between the bobbin 511 and the circular columnar portion 523F is less likely to occur as compared to a case where such axis alignment is not achieved.

Because the magnetic circuit member 52 is supported by the vertical strut via the support section 55, most of the drive force generated in the voice coil 513 is used as thrust force for vibrating the bobbin 511. Further, the vibration member 51 is supported by the sound board 7 and the damper 53 by being connected to the sound board 7. Further, the sound board 7 and the damper 53 are formed respectively of wood and fibers or the like, and thus, the damper 53 is much lower in modulus of rigidity than the sound board 7. Therefore, most of the load of the vibration member 51 would act on the sound board 7. The magnetic circuit member 52 is supported by the support section 55 and connected with the vibration member 51 only via the damper 53. The damper 53 is much lower in modulus of rigidity than any one of the vibration member 51 (aluminum material or resin), the magnetic circuit member 52 (soft magnetic material or magnet) and the support section 55 (metal). Thus, even when the relative positions of the vibration member 51 and the magnetic circuit member 52 have changed, for example, only the damper 53 deforms, and force applied from the damper 53 to the vibration member 51 becomes extremely small. Therefore, almost no load except for that of the vibration member 51 is applied to the sound board 7. Note that the support section 55 may support the magnetic circuit member 52 in any other desired manner than the aforementioned as long as no load other than that of the vibration member 51 acts on the sound board 7.

Figure 12:
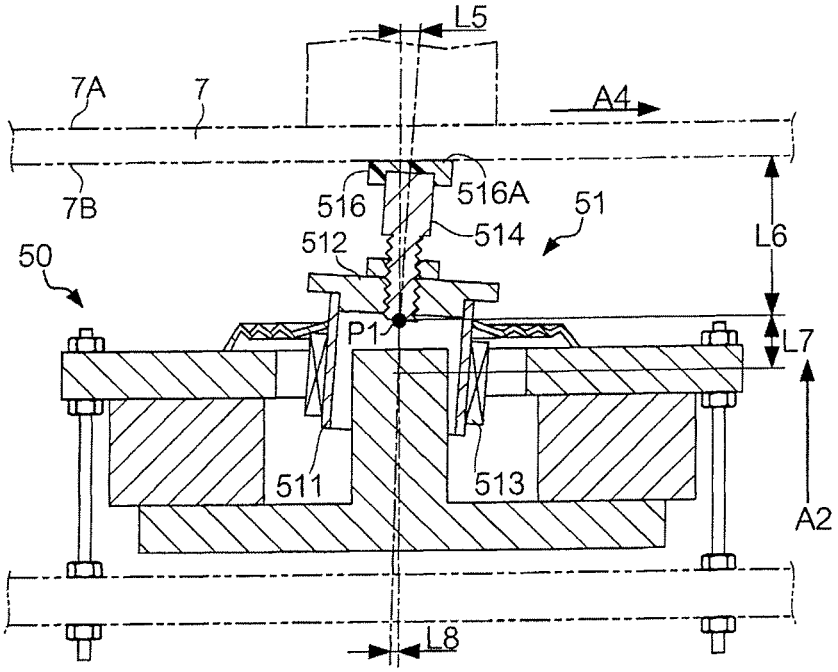
FIG. 12 is a view showing the sound board and the support section positionally displaced relative to each other.

Note that, after the acceleration device 50 has been attached as shown in FIG. 11, relative positions of the support section 55 and the sound board 7 may deviate from each other due to deformation of the grand piano 1, positional deviation of any of the various members. FIG. 12 is a view showing the sound board 7 displaced relative to the support section 55. In the illustrated example of FIG. 12, the sound board 7 has been displaced, relative to the support section 55, by a length L5 in the width direction A4 of the bridge 6. In the vibration member 51, only the bobbin 511 is supported at its outer peripheral surface by the damper 53, apart from the portion (more specifically, the upper surface 516A) at which the spacer 516 is connected to the sound board 7. Thus, if the spacer 516 shifts in the width direction A4 together with the sound board 7, the vibration member 51 will turn about an axis passing through a center P1 of the portion supported by the damper 53 and perpendicularly intersecting the width direction A4. At that time, the upper end portion of the shaft 514 slightly inclines, and the spacer 516, formed of resin, deforms in response to such inclination of the shaft's upper end portion. Here, a distance between the upper surface 516A moving by the length L5 in the axial direction A4 and the center P1 is depicted as L6, and a distance between the center P1 and the middle, in the axial direction A2, of the voice coil 513 is depicted as L7. The distance L6 includes the length of the shaft 514, and thus, the distance L6 is larger than the distance L7. If displacement, in the width direction A4, of the middle, in the axial direction A2, of the voice coil 513 is given as L8, then L8 can be expressed by an expression "L8 =L5/L6×L7". Because L6>L7 as noted above, L8<L5. Namely, when the sound board 7 and the support section 55 have been displaced relative to each other in the width direction A4, an amount of displacement, in the width direction A4, of the voice coil 513 in the vibration device 50 can be made smaller than the amount of displacement.

Figure 13:
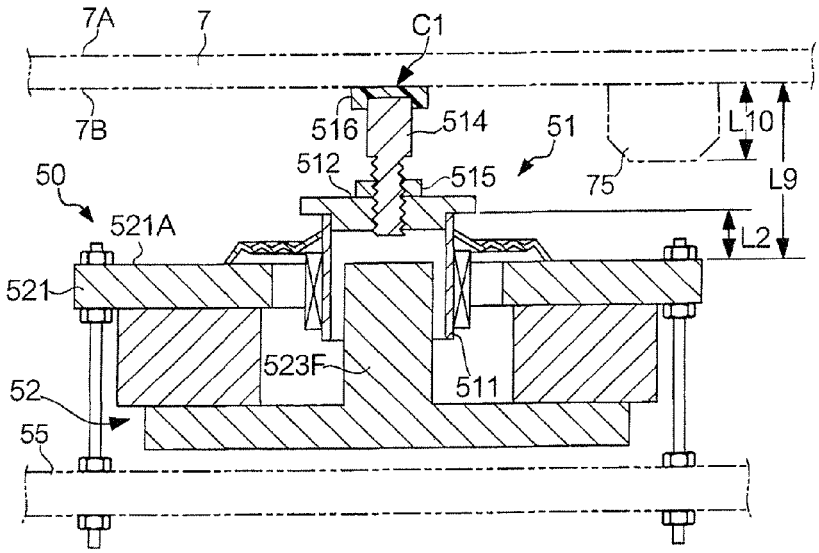
FIG. 13 is a view showing the vibration device mounted at a position where a sound board rib is located above a yoke.

Further, because the magnetic circuit member 52 in the vibration device 50 is supported spaced from the sound board 7 by an amount equal to the length, in the normal line direction A1, of the shaft 514 and the spacer 516, the vibration device 50 can be mounted near the sound board rib 75. FIG. 13 is a view showing the vibration device 50 mounted at a position where the sound board rib 75 is located above the top plate 521. Namely, the sound board rib 75 is provided on the surface of the sound board 7 to which the spacer 516 is connected, i.e. on the lower surface 7B of the sound board 7. A distance between the lower surface 7B and the upper surface 521A of the top plate 521, i.e. a height, from the upper surface 521A, of the upper surface 516A of the spacer 516 connected to the sound board 7, in this state is given as L9, and a height of the sound board rib 75 from the sound board 7 (lower surface 7B) is given as L10. The distance L9, the height L10 and the height L2 from the upper surface 521A to the end of the bobbin 511 are in a relationship of L9>L10>L2. Namely, the aforementioned connection member 51, comprising the cap 512, shaft 514, nut 515 and spacer 516, is constructed to fix the upper surface 516A to the bobbin 511 in such a manner that the distance (L9) of the surface 516A from the magnetic circuit member 52 is greater than the distance (L10) of the sound board rib 75 from the sound board 7. In other words, the connection member can connect the upper surface 516A to the bobbin 511 with its overall length adjusted in such a manner that the distance between the connection end and the bobbin 511 is greater than the distance from the sound board 7 to the sound board rib 75. A modification of the vibration device may, for example, be constructed so as to directly connect and mount the bobbin 511 to the sound board 7. In such a case, however, the height of the bobbin 511 from the upper surface 521A, i.e. the distance between the upper surface 521A and the lower surface 7B becomes L2, and, thus, the vibration device 50 cannot be attached because the sound board rib 75 having the height L10 contacts the top plate 521. The above-described embodiment of the vibration device 50, where the connection end can move in the aforementioned manner, can be attached to the sound board 7 and the support section 55 without the sound board rib 75 contacting the top plate 521.

[Construction of the Control Device 10]

Figure 14:
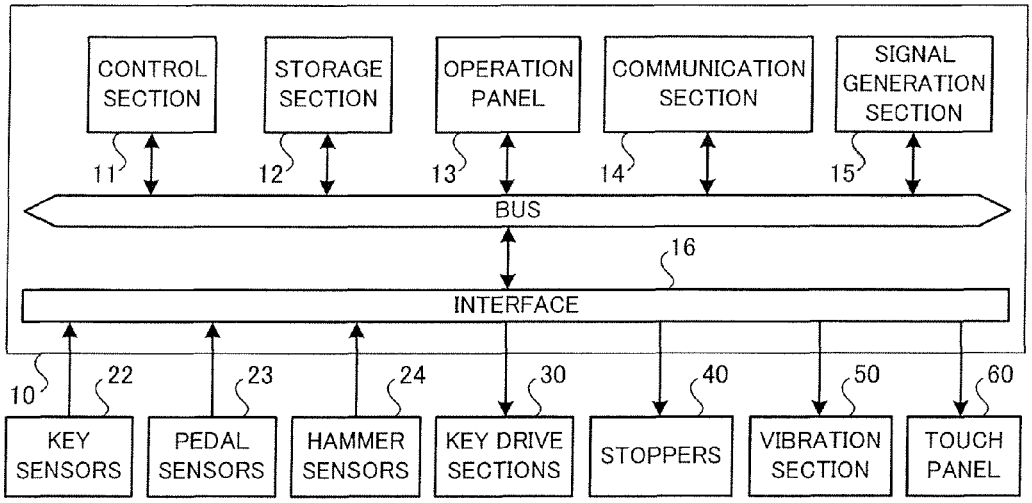
FIG. 14 is a block diagram showing a construction of a control device.

FIG. 14 is a block diagram showing a construction of the control device 10 which includes a control section 11, a storage section 12, the operation panel 13, a communication section 14, a signal generation section 15, and an interface 16. These components 11, 12, 13, 14, 15 and 16 are interconnected via a bus.

The control section 11 includes an arithmetic device, such as a CPU (Central Processing Unit), and storage devices, such as a ROM (Read-Only Memory) and a RAM (Random Access Memory). On the basis of control programs stored in any of the storage devices, the control section 11 controls various components of the control device 10 and various components connected to the interface 16. In the illustrated example, the control section 11 causes the control device 10 and some of the components connected to the control device 10 to function as the musical instrument of the present invention, by executing any of the control programs.

The storage section 12 stores therein setting information indicative of various settings to be used during execution of the control programs. The setting information is information for determining content of a drive signal (audio waveform signal) to be generated by the signal generation section 15 on the basis of detection signals output, for example, from the key sensor 22, pedal sensor 23 and hammer sensor 24. Further, the setting information also includes information indicative of a tone generation mode and performance mode set by the user.

The operation panel 13 includes operating buttons operable by the user (capable of receiving user's operations), etc. Upon receipt of a user's operation via any one of the operating buttons, an operation signal corresponding to the user's operation is output to the control section 11. The touch panel 60 connected to the interface 16 includes a display screen, such a liquid crystal display, and a touch sensor for receiving user's operations are provided on a surface portion of the display screen. On the display screen of the touch panel 60 are displayed, under control via the interface 16 of the control section 11, a setting change screen for changing any of the settings of the setting information stored in the storage section 12, setting screens for setting various modes etc., and various information, such as a musical score. Further, upon receipt of a user's operation via the touch sensor, an operation signal corresponding to the user's operation is output to the control section 11 via the interface 16. Namely, user's instructions to the control device 10 are input through operations received via the operation panel 13 and the touch panel 60.

The communication section 14 is an interface for executing communication with other equipment in wireless, wired and other desired manners. To the interface may be connected a disk drive that reads out various data recorded on a recording medium, such as a DVD (Digital Versatile Disk) or CD (Compact Disk), and outputs the thus-read-out data. Data input to the control device 10 via the communication section 14 are, for example, music piece data for use in an automatic performance.

Figure 15:
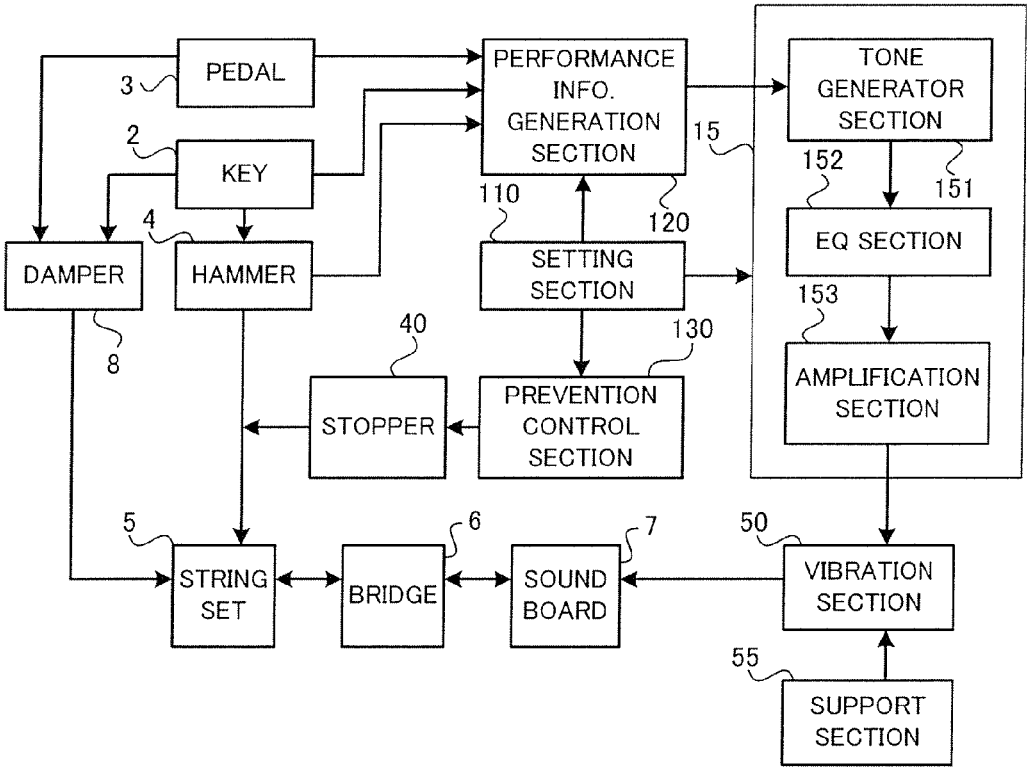
FIG. 15 is a block showing functional components of the grand piano.

The signal generation section 15 includes a tone generator section 151 for outputting an audio signal (audio waveform signal), an equalizer (EQ) section 152 for adjusting a frequency characteristic of the audio signal, and an amplification section 153 for amplifying the audio signal (see FIG. 15). The signal generation section 15 outputs, as a drive signal, the audio signal amplified after having been adjusted in frequency characteristic.

The interface 16 is an interface for connecting the control device 10 with various external elements. In the illustrated example, examples of the external elements connected to the interface 16 include the key sensors 22, pedal sensors 23, hammer sensors 24, key drive sections 30, stoppers 40, vibration device 50 and touch panel 60. The interface 16 outputs to the control section 11 detection signals output from the key sensors 22, pedal sensors 23 and hammer sensors 24 and detection signals output from the touch panel 60. Further, the interface 16 outputs to the key drive sections 30 control signals output from the control section 11 and outputs to the vibration device 50 a drive signal output from the signal generation section 15.

[Functional Arrangements of the Grand Piano 1]

The following describe functions implemented by the control section 11 executing the control program. FIG. 15 is a block showing functional components of the grand piano 1. Once any one of the keys 2 is operated, the hammer 4 strikes the corresponding string set 5, so that the string set 5 vibrates. Such vibration of the string set 5 is transmitted via the bridge 6 to the sound board 7. Further, the corresponding damper 8 operates in response to operations of the key 2 and the pedal 3. Vibration suppression state of the string set 5 is changed by the action of the damper 8.

A setting section 110 is implemented as a functional component having the following functions by means of the touch panel 60 and the control section 11. First, the touch panel 60 receives a user's operation for setting a tone generation mode. The control section 11 changes the setting information in accordance with a performance mode and a tone generation mode set by the user and outputs to a performance information generation section 120 and a prevention control section 130 a control signal indicative of the selected tone generation mode in accordance with these modes.

Further, the touch panel 60 receives user's operations for setting various control parameters for use in the signal generation section 15. The various control parameters are parameters for determining a color (timbre) of an audio signal (audio waveform signal) output from the tone generator section 51, a frequency characteristic adjustment style in the equalizer section 52 and an amplification factor in the amplification section 153. The user may either individually set such control parameters, or set such control parameters by selecting a preset data set from among a plurality of preset data sets, each predefining respective values of the control parameters, stored in the storage section 12. The control section 11 changes the setting information in accordance with the various control parameters and controls a drive signal to be output from the signal generation section 15 in accordance with the control parameters. Predetermined parameters are set in the equalizer 152 and the amplification section 153, which need not necessarily be constructed to be changeable by the control section 11.

The performance information generation section 120 is constructed of the control section 11, the key sensors 22, the pedal sensor 23 and hammer sensors 24 as a functional component having the following functions. Behavior of the pedal 3 and each of the hammers 4 is detected by the corresponding key sensor 22, pedal sensor 23 and hammer sensor 24, and on the basis of detection signals consequently output from these sensors 22, 23 and 24, the control section 11 identifies, as information (performance information) to be used in the tone generator section 151, timing of striking by the hammer 4 of the string set 5 (key-on timing), No. of the key 2 corresponding to the hammer-struck string set 5 (key No.), striking velocity (velocity) and timing of vibration suppression by the damper 8 of the string set 5 (key-off timing). In the illustrated example, the control section 11 identifies the striking timing and key No. of the key 2 on the basis of the behavior of the key 2, the striking velocity on the basis of the behavior of the hammer 4, and the time of vibration suppression on the basis of the behavior of the key 2 and pedal 3. Note that the striking timing may be identified on the basis of the behavior of the hammer 4 and the striking velocity may be identified on the basis of the behavior of the key 2. Further, the performance information may be represented in control parameters of a MIDI (Musical Instrument Digital Interface) format.

At the identified key-on timing, the control section 11 outputs to the tone generator section 151 of the signal generation section 15 performance information indicative of the key No., velocity and key-on instruction. Further, at the identified key-off timing, the control section 11 outputs to the tone generator section 15 performance information indicative of the key No. and key-off instruction. When the user-set tone generation mode is the weak tone mode or strong tone mode, the control section 11 performs the aforementioned functions, while, when the user-set tone generation mode is the normal tone mode, the control section 11 in the illustrated example outputs no performance information to the tone generator section 151. In the normal tone generation mode, it just suffices to prevent a drive signal from being generated/output from the signal generation section 15; thus, even where the embodiment is constructed to generate/output performance information, it just suffices for the control section 11 to perform control such that no drive signal is generated/output from the signal generation section 15. The performance information generation section 120 and the signal generation section 15, cooperating in the aforementioned manner, function as an output means for outputting to the vibration device (actuator) 50 a drive signal indicative of a sound or tone corresponding to operations of performance operators comprising the key 2 and pedal 3.

The prevention control section 130 is implemented by the control section 11 as a component having the following function. When the user-set tone generation mode is the weak tone mode, the control section 11 moves the stopper 40 to a position for preventing the hammer 4 from striking the corresponding string set 5, while, when the user-set tone generation mode is the normal tone generation mode or strong tone mode, the control section 11 moves the stopper 40 to a position for not preventing the hammer 4 from striking the string set 5.

The tone generator section 151 outputs an audio signal (audio waveform signal) on the basis of performance information generated from the performance information generation section 120 (control section 11). For example, the tone generator section 151 outputs an audio signal (audio waveform signal) with a tone pitch corresponding to the key number and with a tone volume corresponding to the velocity. This audio signal (audio waveform signal) is adjusted in frequency characteristic by the equalization section 152, amplified by the amplification section 153 and then supplied to the vibration device 50 as a drive signal, as noted above. As also noted above, the vibration device 50 vibrates in response to the supplied drive signal to thereby vibrate the sound board 7. The vibration of the sound board 7 is transmitted to the bridge 6, by way of which it is transmitted to the string set 5.

By the audio waveform signal being generated with the tone pitch (frequency) corresponding to the key No. of the key operated for a performance as noted above, a vibration sound generated by the sound board 7 vibrating in accordance with the audio waveform signal (drive signal) will have a tone pitch corresponding to the tone pitch of the operated key. The vibration sound generated by the sound board 7 can also be subjected to velocity control (i.e., volume control corresponding to a key touch). However, the frequency etc. of the audio waveform signal may be modified variously without being limited to the aforementioned processing. For example, a signal obtained by mixing audio waveform signals of a plurality of tone pitches, such as those of a chord, may be used as a drive signal to vibrate the sound board 7.

[Modifications of the First Embodiment]

The above-described embodiment is only one example of the first embodiment of the present invention, and the first embodiment may be modified variously as follows. Further, the above-described embodiment and the following modifications may be practiced in combination as necessary.

<Modification 1>

The fixing jig may have a different shape than the above-described fixing jig 54 and need not necessarily have the function of being capable of being automatically positioned in desired positional relationship. Namely, the fixing jig may have any desired shape as long as, with the fixing jig mounted to the top plate 521, the height of the upper end of the bobbin 511 from the upper surface 521A of the top plate 521 is L2 (the voice coil 513 is positioned at a predetermined reference mounting position within the magnetic path space), i.e. the fixing jig functions as the reference position instructing member indicating whether the voice coil 513 is positioned in desired positional relationship with respect to the magnetic path space 525 in such a manner that such positional relationship is automatically or visually checked by the human operator.

Figure 16:
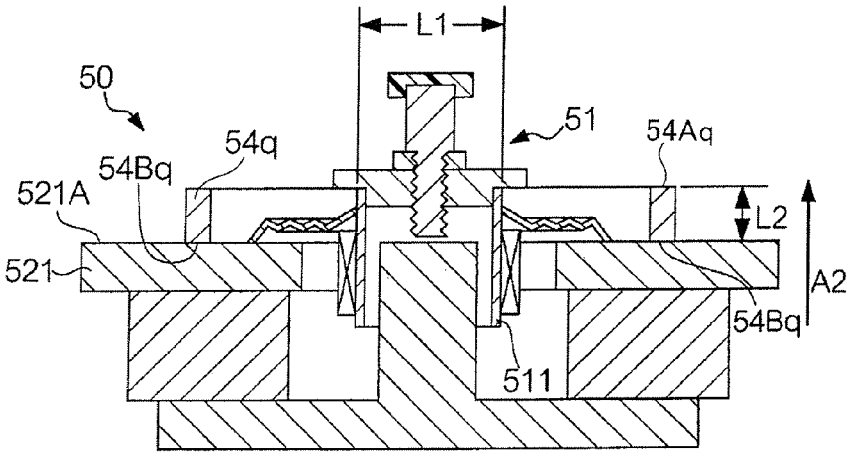
FIG. 16 is a view showing a modified fixing jig mounted.

FIG. 16 is a view showing the modified fixing jig 54*q* mounted to the magnetic circuit member 52. This modified fixing jig 54*q* does not have an automatic positioning function like that of the fixing jig 54; instead, it performs a function of presenting a reference position indicative of whether the voice coil 513 is currently positioned in desired positional relationship with respect to the magnetic path space 525 in such a manner that the reference position can be visually checked by the human operator. More specifically, the fixing jig 54*q* is shaped such that it is devoid of a portion located inward of the lower surface 54B of the fixing jig 54 shown in (b) of FIG. 7. In FIG. 16, the fixing jig 54*q* is mounted out of contact with its lower surface 54Bq placed in contact with the upper surface 521A of the top plate 521. Namely, the fixing jig 54*q* may be mounted to the magnetic circuit member 52. In this case, the human operator may mount the fixing jig 54*q* to the magnetic circuit member 52 at step S11 of FIG. 6, then move the shaft 514 until the upper surface 516A (connection end) contacts the sound board 7 and then adjust the length of the shaft 514, while visually checking the length, so that the upper end of the bobbin 511 is brought into alignment with the upper surface 54Aq of the fixing jig 54*q*. In this manner, the human operator connects the upper surface 516A to the sound board 7 (step S14) in such a manner that the coil length middle and the magnetic path width middle substantially coincide with each other, i.e. relative positions of the vibration member 51 and the magnetic circuit member 52 are set in the above-mentioned desired relationship.

Note that the fixing jig mounted in place need not necessarily have the height L2 from the upper surface 512A; for example, the fixing jig may be mounted in such a manner that the upper surface 512A of the cap 512 is at the height L2 from the top plate 521 (upper surface 521A), or that a mark put somewhere on the vibration member 51 is at the height L2 from the upper surface 521A. In short, the fixing jig may be at any desired height from the upper surface 521A as long as the height from the upper surface 521A can function as a reference for the human operator to visually check a position of the vibration member 51 when the coil length middle and the magnetic path width middle substantially coincide with each other.

<Modification 2>

Figure 17:
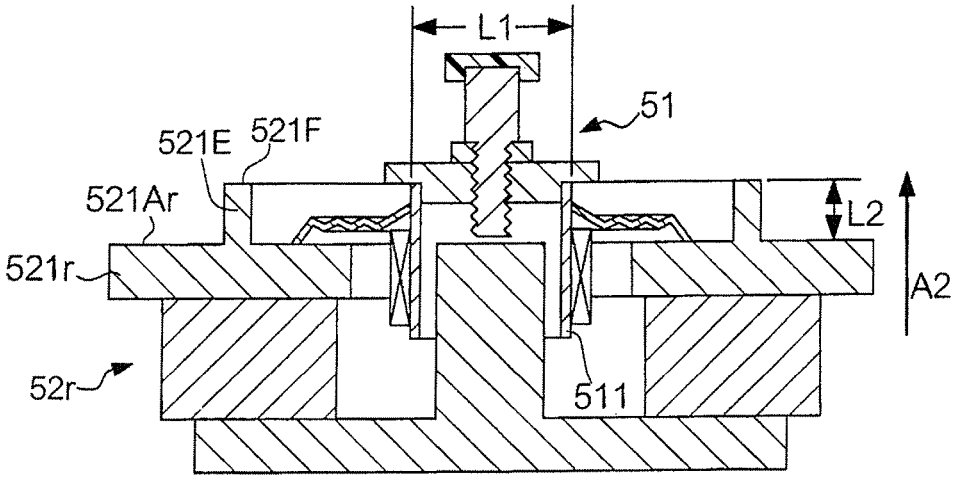
FIG. 17 is a view showing a modified magnetic circuit member.

In place of the fixing jig, the magnetic circuit member 52 may include a portion formed thereon so as to permit checking of the position of the vibration member 51 when the coil length middle and the magnetic path width middle substantially coincide with each other. FIG. 17 is a view showing a modified magnetic circuit member 52*r* whose top plate 521*r* has an upper surface 521Ar and a projecting portion 521E formed on the upper surface 521Ar and having the height L2 from the upper surface 521Ar. When moving upward the shaft 514 at step S14 of FIG. 6, the human operator adjusts the position of the shaft 514 in such a manner that the upper end of the bobbin 511 is located at a position along (in alignment with) the upper surface 521F of the projecting portion 521E. Namely, the modified magnetic circuit member (magnetic path formation section) 52*r* has the projecting portion 512E indicating a relative position of the voice coil 513 to the vibration member 51, i.e. whether the voice coil 513 is positioned in desired positional relationship with the magnetic path space 525. Namely, the projecting portion 512E functions as the reference position instructing member indicating whether relative positions, in the axial direction of the bobbin 511, of the voice coil 513 and the magnetic path space 525 are currently set in desired relationship. Thus, the human operator can adjust, while visually checking, the position of the vibration member 51 relative to the magnetic circuit member 52 in such a manner that the coil length middle and the magnetic path width middle substantially coincide with each other.

<Modification 3>

As another modification, the magnetic circuit member 52 may be supported by the support section in a manner different from the above-described. For example, through-holes may be formed in the yoke 523, not in the top plate 521, to extend through the thickness, i.e. from the upper surface to the lower surface, of the yoke 523, so that the magnetic circuit member 52 can be supported by the support section 55 by means of the support rods 551 and the plurality of nuts 552. Further, although the magnetic circuit member 52 is supported out of contact with the support section 55 in the illustrated example of FIG. 9, it may be supported in contact with the support section 55. Further, whereas the support section 55 is fixed to the casing of the grand piano 1 in the above-described embodiment, it may be fixed to any other suitable part than the grand piano casing, such as the ground surface (floor). In any case, it just suffices for the magnetic circuit member 52 to be supported in such a manner that the distance from the bobbin 511 to the sound board 7 falls within the aforementioned end moving range.

<Modification 4>

Figure 18:
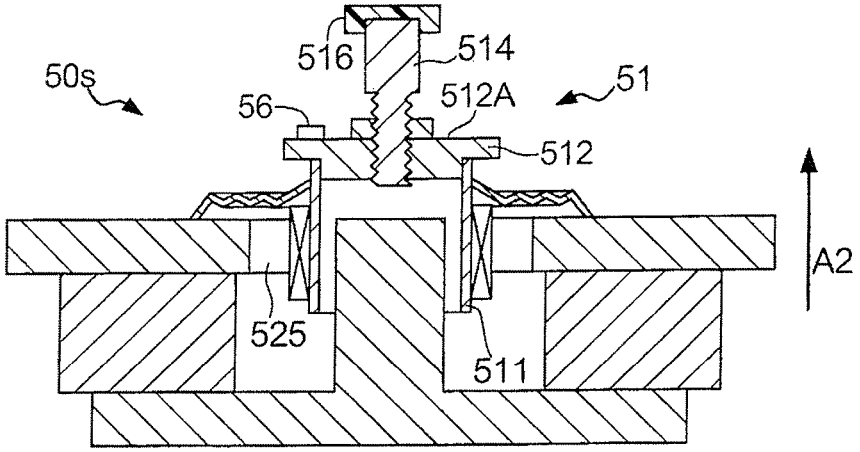
FIG. 18 is a view showing a modified vibration device.

As still another modification of the vibration device 50, a heat sensor for measuring a temperature may be mounted on the flat upper surface 512A of the cap 512 shown in FIG. 5 for measuring heat produced from the voice coil 513. FIG. 18 is a view showing the modified vibration device 50*s*. The heat sensor 56 is mounted on the vibration member 51 of the vibration device 50*s*. The heat sensor 56 is a temperature measurement means provided in contact with the upper surface 512A of the cap 512 for measuring a temperature of the upper surface 512A.

In order to measure heat produced from the voice coil 513, it is desirable that the heat sensor 56 be placed in contact with a position to which the heat can easily transfer. For example, the bobbin 511 is placed in direct contact with the voice coil 513 and is the most easily-heat-transferable member of all of the component members of the vibration device 50. However, because the bobbin 511 is a circular cylindrical member and thus the heat sensor 56 has to be mounted on a curved surface of the bobbin 511, it is difficult to mount the heat sensor 56 on the bobbin 511. Further, although a surface of the top plate 521 facing the magnetic path space 525 is located closest to the voice coil 513, heat from the voice coil 513 would not sufficiently transfer to the top plate 521 due to a space interposed between the top plate 521 and the voice coil 513. It has been experimentally known that the heat would not sufficiently transfer to the top plate 521 even by way of the damper 53, and thus, even if the heat sensor 56 is mounted on the top plate 521, only a value considerably different from an actual temperature of the voice coil 513 can be measured by the heat sensor 56.

Because the upper surface of the cap 512 is a flat surface and has a necessary area for mounting thereon the heat sensor 56, it is easier to mount the heat sensor 56 on the upper surface of the cap 512 than on the bobbin 511. Further, the cap 512 is formed of metal aluminum material and has a greater thermal conductivity, for example, at a temperature of 25° C. than iron or resin, such as polyethylene. Thus, as compared to the case where the cap 512 is formed of iron or resin, the cap 512 can easily transfer heat and can measure a value close to an actual temperature of the voice coil 513. Note that the heat sensor 56 may be mounted on the lower surface of the cap 512. If a wire connecting to the heat sensor 56 is passed between the bobbin 511 and the yoke 523, the wire may undesirably contact the yoke 523, and force may be produced due to magnetic force in the magnetic path space 525 and an electric current flowing through the wire, so that force to be imparted to the sound board 7 may vary. Thus, the wire connecting to the heat sensor 56 is preferably passed through a hole, which is formed to extend through the cap 512 up to the upper surface 512A, so that the need for passing the wire between the bobbin 511 and the yoke 523 can be eliminated.

The heat sensor 56 mounted on the cap 512 in the aforementioned manner supplies the control section 11 of FIG. 14 with data indicative of the measured temperature. If the temperature indicated by the data supplied from the heat sensor 56 is greater than a threshold value, the control section 11 controls the signal generation section 15 in such a manner that the signal generation section 15 generates such a drive signal as to reduce the heat produced from the voice coil 513, more specifically to reduce the electric current flowing to the voice coil 513. Thus, as the temperature measured by the heat sensor 56 gets greater than the threshold value, it is possible to lower the temperature of the voice coil 513 by eliminating heat having been produced from the voice coil 513. Note that the control section 11 may control the signal generation section 15 to progressively change the drive signal so that heat produced from the voice coil 513 is progressively reduced.

<Modification 5>

The cap 512 may be shaped to radiate heat with an increased ease. Heat produced from the voice coil 513 is radiated into the air by way of the top plate and yoke 521, 523 or the bobbin 511. If the heat produced from the voice coil 513 is radiated into the air by way of the top plate and yoke 521, 523, an amount of heat transferred from the voice coil 513 tends to be small because these yokes are separated from the voice coil 513 by the air, although these yokes have a great surface area and thus can radiate much heat. As compared to the above-mentioned yokes, the bobbin 511 can radiate only a small amount of heat because an area contacting the air is small, although a great amount of heat is transferred to the bobbin 511 by virtue of direct contact between the bobbin 511 and the voice coil 513. However, because the heat transferred to the bobbin 511 transmits to the cap 512 as well, it is radiated from the cap 512 into the air via the cap 512. Therefore, in a case where it is necessary to increase heat radiation, the cap 512 may be shaped to radiate heat with an increased ease.

Figure 19:
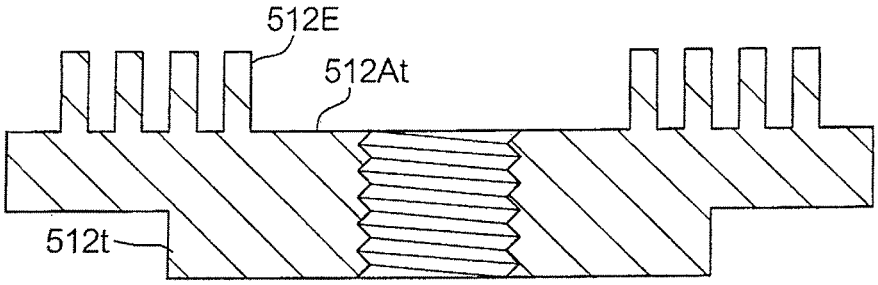
FIG. 19 is a view showing a modified cap.

FIG. 19 is a view showing an example of such a modified cap. The cap 512*t* is formed of aluminum material and has a plurality of fins 512E formed on the upper surface 512At and projecting upward from the upper surface 512At. With such fins 512E, the modified cap 512*t* has a greater surface area than the cap 512 employed in the above-described surface area. Thus, the cap 512*t* can radiate air with an increased ease as compared to other caps, such as the cap 512, having no such fin. Note, however, the modified cap need not necessarily be of the type having fins; in short, it just suffices for the cap to be shaped to radiate heat with an increased ease. Heat transferred from the voice coil 513 also transmits to the shaft 514 and the nut 515, and thus, in a case where it is necessary to increase heat radiation, the shaft 514 and the nut 515 too may be shaped to radiate heat with an increased heat as long as they can be rotated to move axially with no difficulty.

<Modification 6>

Whereas the vibration member 51 in the above-described embodiment has the spacer 516, the spacer 516 may be dispensed with or omitted, in which case the upper end surface of the shaft 514 directly connects to the sound board 7. In the above-described embodiment, the bobbin 511, the cap 512 and the shaft 514 are each formed of aluminum material. If, in that case, the vibration member 51 connects to the sound board 7 directly, i.e. not via the spacer 516, more of heat produced from the voice coil 513 can be transmitted to the sound board 7 than in the case where the vibration member 51 connects to the sound board 7 via the spacer 516. Thus, in this case, the sound board 7 would be influenced more by the heat, particularly if the sound board 7 is formed of wood as in the above-described embodiment. This is true even where the nut 515, a part of the nut 515, a part of the shaft 514, etc. are formed of material of smaller conductivity than the spacer 516. Namely, if the vibration member 51 includes the spacer 516 and a portion greater in thermal conductivity than the spacer 516, heat transmitted via the spacer 516 to the sound board 7 would be reduced and thus influences given by the heat to the sound board 7 can be reduced, as compare to the case where heat is transmitted to the sound board 7 not via the spacer 516.

On the other hand, if the influence of the heat on the sound board 7 is nominal, e.g. because the heat produced from the voice coil 513 is of a small amount, the heat may be transmitted to sound board 7 not via the spacer 516. In such a case, because the heat is transmitted to sound board 7 not via the spacer 516, energy loss would be small and thus vibration of the vibration member 51 would give great force to the sound board 7, as compared to the case where the spacer 516 is sandwiched between the shaft 514 and the sound board 7.

<Modification 7>

The bobbin 511, the cap 512, the shaft 514, the nut 515 and the spacer 516 may be formed of material different from the material employed in the above-described embodiment. For example, whereas the bobbin 511, the cap 512 and the shaft 514 have been described as formed of metal aluminum material, they may be formed of any other material, such as copper, resin, plastic or the like, as long as the material satisfies conditions required of the voice coil type actuator, such as a strength, weight, non-magnetic/magnetic property, absence/presence of heat resistant property, etc.

<Modification 8>

Figure 20:
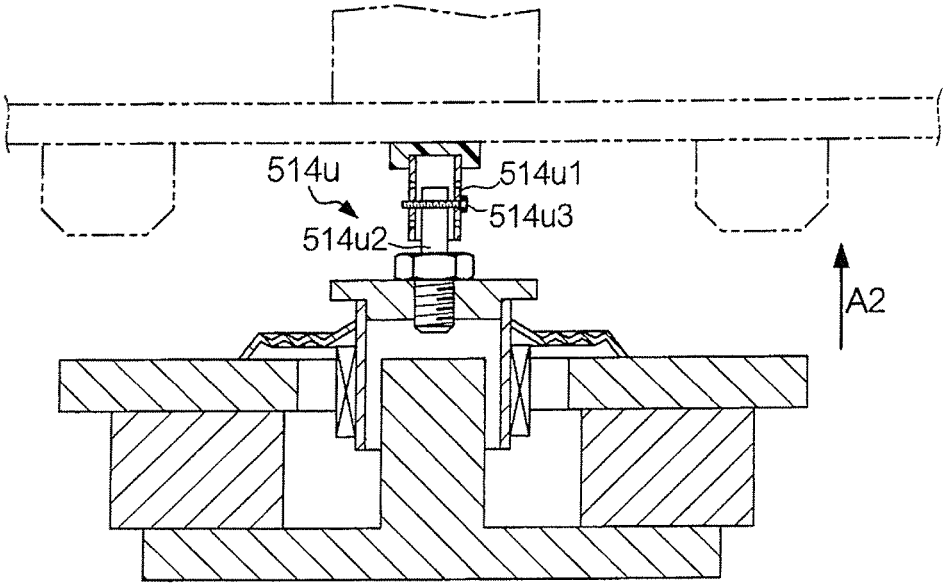
FIG. 20 is a view showing a modified shaft.

As still another modification, the shaft 514 may have a shape different from that in the above-described embodiment. FIG. 20 is a view showing an outer appearance of an example of the modified shaft 514*u*. The modified shaft 514*u* includes a tubular member 514*u*1, an axially-extending member 514*u*2 extending in the axial direction A2, and a bolt 514*u*3. The axially-extending member 514*u*2 includes a circular columnar portion formed in a circular columnar shape having a diameter smaller than the inner diameter of the tubular member 514*u*1, and a male screw portion extending integrally from the circular columnar portion and having a male thread formed thereon. The axially-extending member 514*u*2 is fixed to the hole portion 512G of the cap 512 by means of the nut with the male screw portion screwed in the hole portion 512G. The circular columnar portion of the axially-extending member 514*u*2 has a single hole formed in the circular columnar portion and extending diametrically therethrough, i.e. perpendicularly to the axial direction A2. The tubular member 514*u*1 is fixed, at its one end portion in the axial direction A2, to the spacer 516 by an adhesive agent or the like. Further, the tubular member 514*u*1 has holes formed therein at a plurality of (e.g., four) different positions spaced from one another in the axial direction A2 so as to extend diametrically through the entire shaft 514*u* (i.e., the tubular member 514*u*1 and the axially-extending member 514*u*2) perpendicularly to the axial direction A2. A female thread is formed in each of the plurality of holes formed through the tubular member 514*u*1 and the axially-extending member 514*u*2 so that the bolt 514*u*3 can be screwed in any one of the holes. A portion of the bolt 514*u*3 which has a male thread formed thereon has a length greater than the outer diameter of the tubular member 514*u*1 so as to extend diametrically through the tubular member 514*u*1. Further, the circular columnar portion of the axially-extending member 514*u*2 is inserted inside the tubular member 514*u*1, and the bolt 514*u*3 is screwed through any one of the holes formed in the tubular member 514*u*1 and the single hole of the circular columnar portion of the axially-extending member 514*u*2 with the one hole of the tubular member 514*u*1 and the single hole of the circular columnar portion aligned with each other. In this manner, the axially-extending member 514*u*2 and the tubular member 514*u*1 are fixed. The shaft 514*u* is changeable in height position in a plurality of steps (e.g., four steps) by changing the hole of the tubular member 514*u*1 in which the bolt 514*u*3 is to be screwed.

Figure 21:
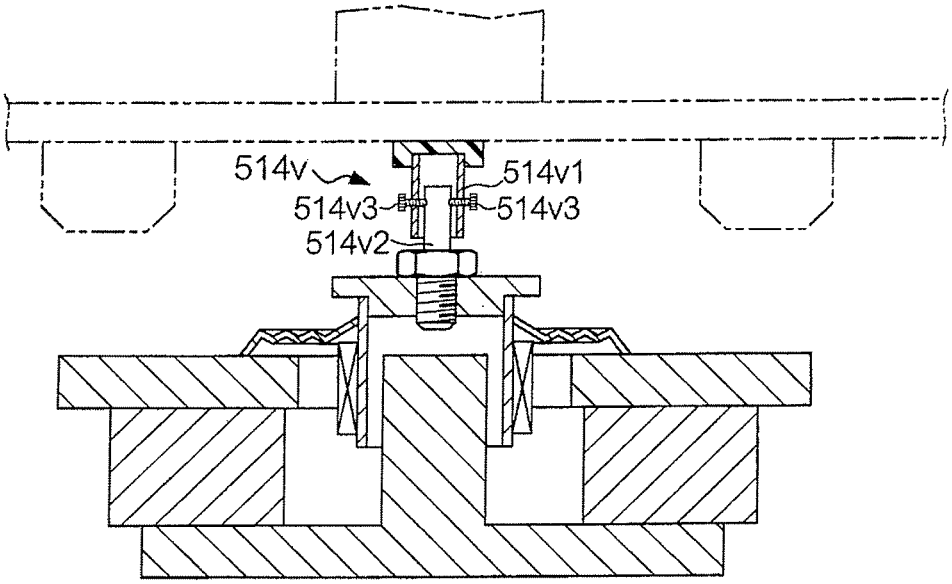
FIG. 21 is a view showing a modified shaft.

FIG. 21 is a view showing an outer appearance of another example of the modified shaft 514*v*. The modified shaft 514*v* includes a tubular member 514*v*1, an axially-extending member 514*v*2 extending in the axial direction A2, and two bolts 514*v*3. The tubular member 514*v*1 has two holes formed therein at one position (not four positions) and extending diametrically through the entire shaft 514*v* perpendicularly to the axial direction A2. Namely, the modified shaft 514*v* is similar to the aforementioned modified shaft 514*u* except that the two holes are formed opposed to each other in the direction perpendicular to the axial direction A2. In other words, the modified shaft 514*v* is similar to the aforementioned modified shaft 514*u* except that no hole is formed in the circular columnar portion. In a portion of the volt 514*v*3 having a male thread formed therein has a predetermined length such that the distal end of the threaded portion can reach the circular columnar portion when the threaded portion is screwed through the hole of the tubular member 514*v*1. Further, in the shaft 514*v*, the two bolts 514*v*3 are screwed in corresponding ones of the two holes of the tubular member 514*v*1 with the circular columnar portion of the axially-extending member 514*v*2 inserted inside the tubular member 514*v*1, and the tubular member 514*v*1 and the axially-extending member 514*v*2 are fixed relative to each other by the respective distal ends of the two bolts 514*v*3 pressed against the circular columnar portion. The shaft 514*v* can be continuously changed in height from the cap 512, by changing the position where the respective distal ends of the two bolts 514*v*3 are pressed against the circular columnar portion.

Because the height of the modified shaft from the cap 512 is changeable, the vibration member having the modified shaft can be fixed at the connection end to the bobbin 511 in such a manner that the distance from the bobbin 511 to the upper surface 516A of the spacer 516 falls within a predetermined range. Thus, the aforementioned connection member, i.e. the cap 512, shaft 514, nut 515 and spacer 516, can be fixed after being adjusted in overall length in such a manner that it is connected at the connection end to the sound board 7 while allowing the voice coil 513, provided on the bobbin 511, to be positioned at a predetermined position within the magnetic path space 525 as shown in FIG. 5. In short, the shaft may be of any shape as long as the connection member including the shaft can be fixed after being adjusted in overall length as noted above.

<Modification 9>

A position where the lower end of the shaft 514 is located higher than the lower end of the hole portion 512G may be preset as an upper limit position within the shaft moving range. Even in this case, it just suffices that the connection member be capable of being fixed after being adjusted in overall length in such a manner that it is connected at the connection end to the sound board 7 while allowing the voice coil 513, provided on the bobbin 511, to be positioned at a predetermined position within the magnetic path space 525. Here, "allowing the voice coil 513, provided on the bobbin 511, to be positioned at a predetermined position" means allowing the voice coil 513 and the top plate 521 to have predetermined positional relationship, e.g. allowing the voice coil 513 to be opposed to the top plate 521.

<Modification 10>

In the sequence of operations for attaching the vibration device 50 to the grand piano 1, the operation of step S11 may be performed after other operations (steps S12 and S13) as long as it is performed before the operation of step S14. In short, it just suffices that the fixing jig 54 be fixed in such a manner as to allow the human operator to automatically or visually confirm, at the time of the movement of the shaft 514 at step S14, that relative positional relationship of the vibration member 51 to the magnetic circuit member 52 achieves a state where the coil length middle and the magnetic path width middle substantially coincide with each other.

<Modification 11>

Further, in the above-described embodiment of the vibration device 50, the damper 53 may be dispensed with. In such a case, because the assembly of the vibration member 51 and the assembly of the magnetic circuit member 52 are not connected with each other prior to attachment of the vibration device 50 to the sound board 7, the operations of steps S13 and S14 of FIG. 16 are performed before step S12 so as to first attach the assembly of the vibration member 51 to a predetermined position of the sound board 7. Then, the operation of step S12 is performed for installing the magnetic circuit member 52 on the support section 55 in such a manner that the bobbin 511 provided with the voice coil 513 is appropriately accommodated within the magnetic path space of the magnetic circuit member 52. After that, the operation of step S14 is performed for adjusting the length of the shaft 514 in such a manner that relative positional relationship of the vibration member 51 to the magnetic circuit member 52 achieves a state where the coil length middle and the magnetic path width middle substantially coincide with each other.

[Second Embodiment of the Vibration Device]

Figure 22:
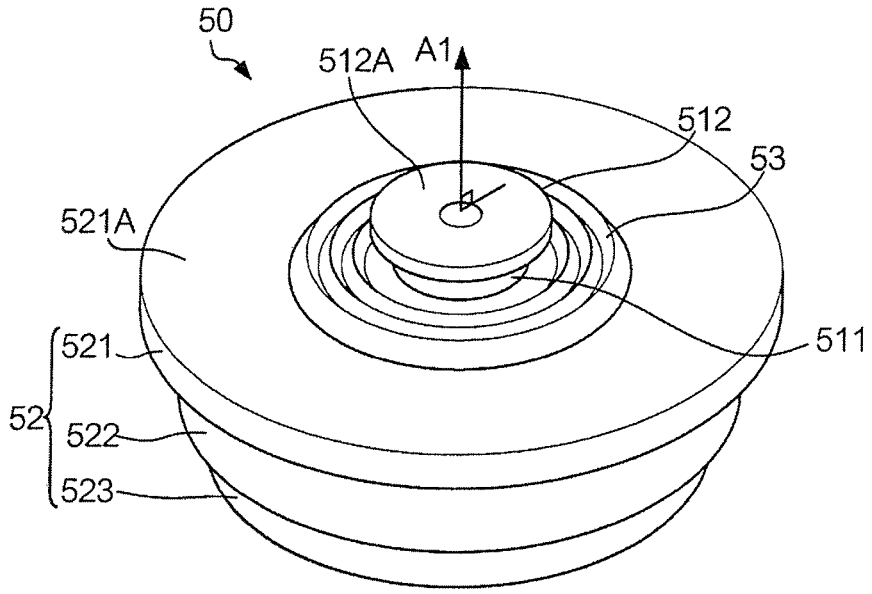
FIG. 22 is a view showing an outer appearance of a second embodiment of the vibration device of the present invention.

FIG. 22 is a view showing an outer appearance of a second embodiment of the vibration device 50A of the present invention. The second embodiment of the vibration device 50A does not include the mounting shaft 514 as employed in the first embodiment of the vibration device 50. Although the second embodiment of the vibration device 50A is different from the first embodiment of the vibration device 50 in terms of the structure by which the vibration device 50A is attached to the sound board 7, it may be similar to the first embodiment of the vibration device 50 in terms of the other structures by which it performs its primary function as a vibration device. Thus, in the following description and drawings pertaining to the second embodiment, similar elements to the first embodiment are indicated by the same reference numerals as used in the first embodiment and will not be described here to avoid unnecessary duplication.

According to the second embodiment, as shown in FIG. 22, a vibration section 51 of the vibration device 50A comprises the bobbin 511 and the cap 512. The cap 512 is a disk-shaped end member mounted at the distal end of the bobbin 511. In the second embodiment, the upper surface 512A of the cap or end member 512 functions as the "connection end" for connection to the sound board 7.

Figure 23:
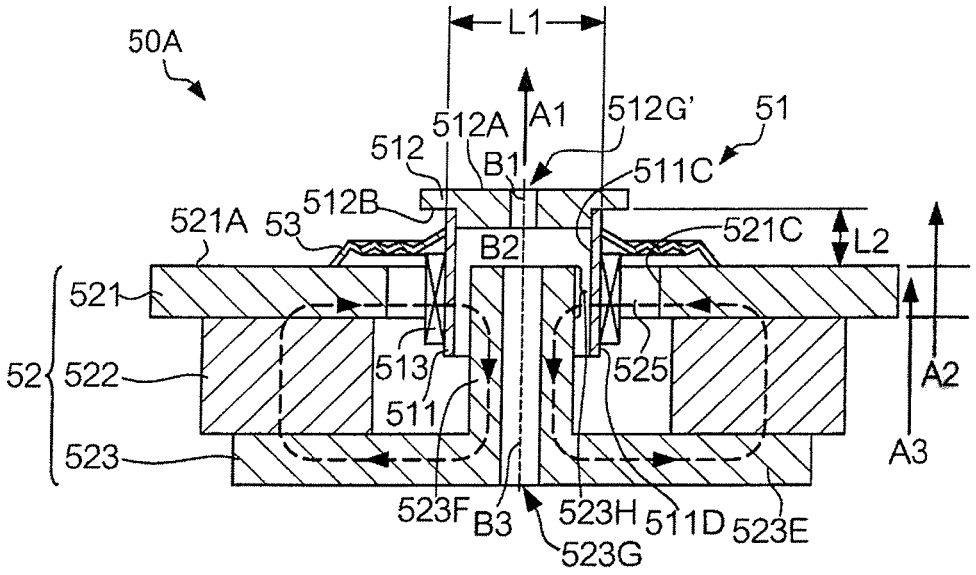
FIG. 23 is a vertical sectional view of the second embodiment of the vibration device shown in FIG. 22.

FIG. 23 is a vertical sectional view of the second embodiment of the vibration device 50A. The second embodiment of the vibration device 50A is different from the first embodiment of the vibration device 50 shown in FIG. 5 in that it does not include the mounting parts depicted at reference numerals 514, 515 and 516 in FIG. 5, in that no male thread is formed in the central hole portions 512G of the cap 512 of the bobbin 511, in that the cap 512 is formed of material different from the material in the first embodiment, and in that a through-hole portion 523G is formed through the disk portion 523E and circular columnar portion 523F of the yoke 523. The other structures in FIG. 23 are substantially similar to the corresponding structures shown in FIG. 5.

The cap 512 in the second embodiment shown in FIGS. 22, 23, etc. is formed of material like resin and fixedly mounted on and closes an upward opening portion of the bobbin 511. The cap 512 has a hole portion 512G' extending centrally through upper and lower portions thereof. The axis line B1 of the hole portion 512G' coaxially aligns with the axis line B2 of the bobbin 511. Further, the yoke 523 has the through-hole portion 523G extending through both of the disk portion 523E and the circular columnar portion 523F in the axial direction A3. Namely, the through-hole portion 523G extends through the magnetic circuit member 52 in the axial direction A3. As described later, the through-hole portion 523G has an inner diameter size to permit passage therethrough of a wood screw (fastening member) 61 for connecting the cap (end member) 512 to the sound board 7. The hole portion 512G' is formed in the cap 512 at a position corresponding to the hole portion 523G of the yoke 523 and in axial alignment with the hole portion 523G. The hole portion 512G', which is formed for passage therethrough of a threaded portion of the wood screw (fastening member) 61, functions as a mark for designating a position where the wood screw (fastening member) 61 is to be fastened in the surface of the cap (end member) 512 opposed to the hole portion 523G.

Figure 24:
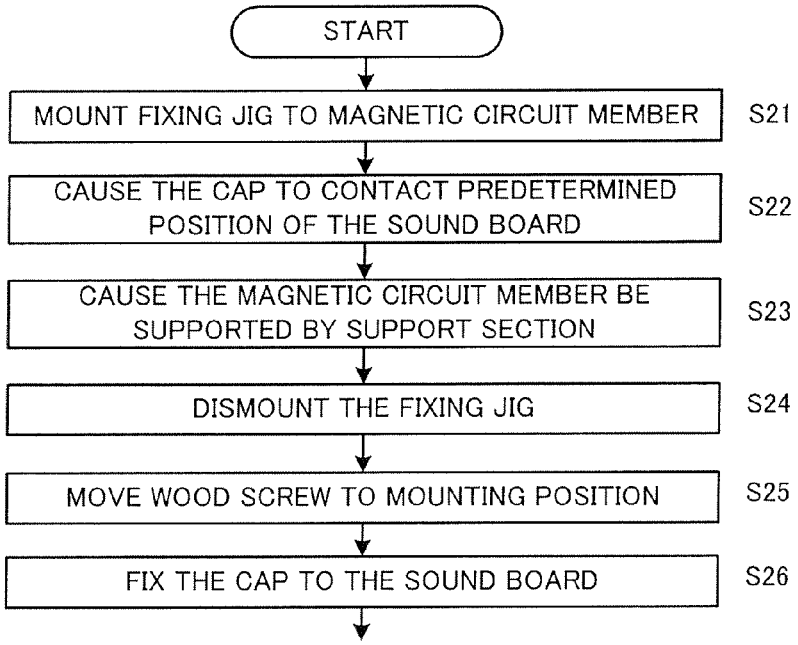
FIG. 24 is a flow chart showing a sequence of operations for attaching the second embodiment of the vibration device to the grand piano.

Next, with reference to FIGS. 24 to 27, a description will be given about a sequence of operations performed by the human operator for attaching the second embodiment of the vibration device 50A to the grand piano 1. FIG. 24 is a flow chart showing the sequence of operations for attaching the vibration device 50A to the grand piano 1. First, as in the above-described first embodiment, the grand piano 1 to which the vibration device 50A has not been attached yet is provided, and the support section 55 is mounted to a predetermined portion, such as the vertical strut 9, of the grand piano 1. Like the sequence of operations shown in FIG. 6, the sequence of operations shown in FIG. 24 is started up with the support section 55 connected to the vertical strut 9. The human operator mounts a predetermined fixing jig to the magnetic circuit member 52 (step S21). The same fixing jig 54 (FIG. 7) used in the first embodiment may be used in the second embodiment.

Figure 25:
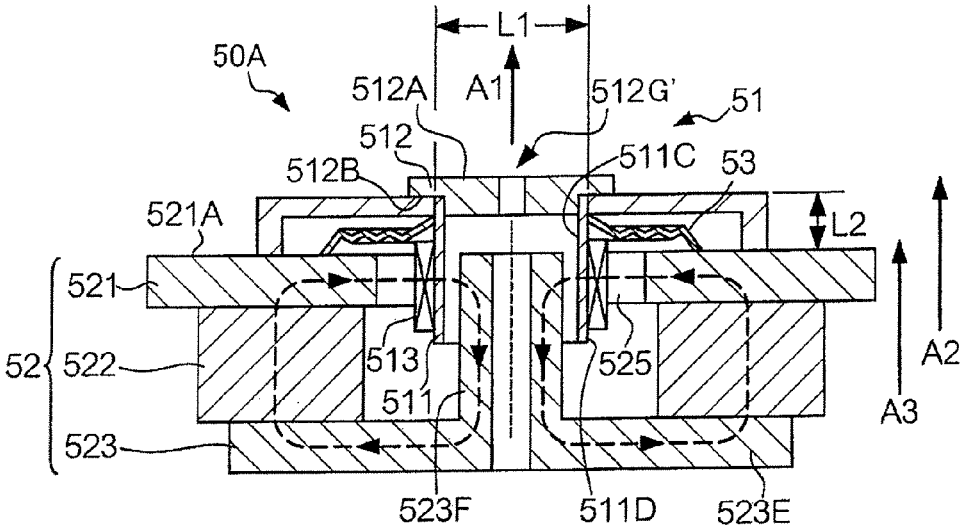
FIG. 25 is a view showing the vibration member and the magnetic circuit member provisionally fixed in position by means of the fixing jig.

FIG. 25 is a view showing the vibration member 51 restricted in position and orientation relative to the magnetic circuit member 52 by means of the fixing jig 54. As in the illustrated example of FIG. 8, the fixing jig 54 is installed with its lower surface 54B in contact with the upper surface 521A of the top plate 521 and fixed to the upper surface 521A by attractive force (magnetic attractive force) from the top plate 521. The fixing jig 54 is mounted in place so as to sandwich the bobbin 511 between the straight portions 541 and 542 (i.e., to accommodate the bobbin 511 in the U-shaped inner space).

Referring back to FIG. 24, the human operator then causes the cap portion 512 to contact a predetermined position of the sound board 7 (step S22). The "predetermined position" is preset as a position at which the vibration device 50A should impart vibration to the sound board 7, and it is, for example, a position located opposite to the bridge 6H or 6L across the sound board 7. Then, the human operator causes the magnetic circuit member 52 to be supported by the support section 55 (step S23). Step S23 is an example of the "support step" in the present invention.

Figure 26:
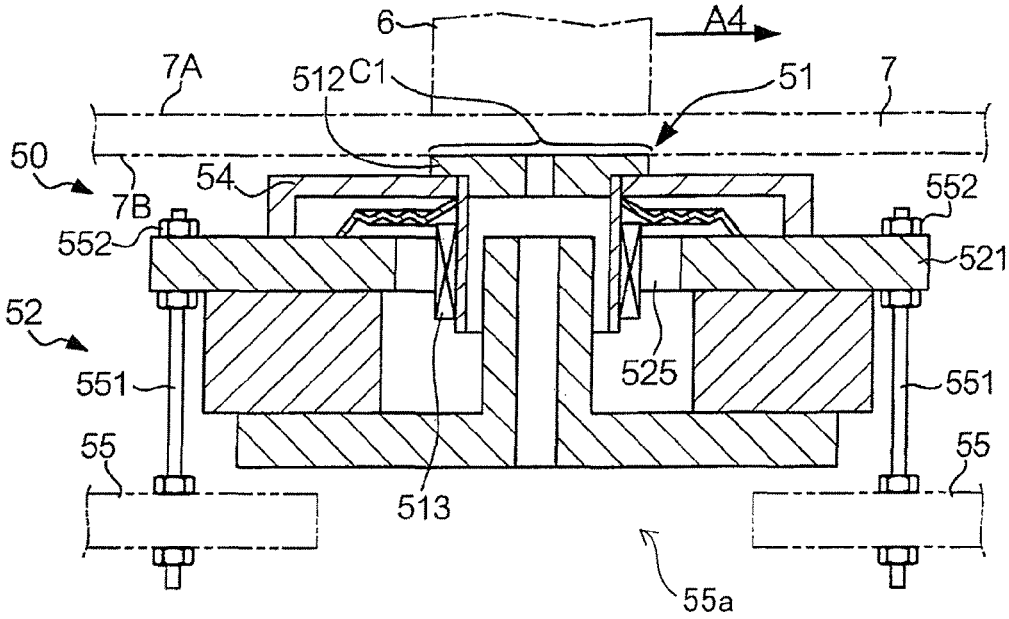
FIG. 26 is a view showing the magnetic circuit member supported by the support section.

FIG. 26 is a view showing the magnetic circuit member 52 supported by the support section 55 in the aforementioned manner. In FIG. 26, the positions of the sound board 7, bridge 6 and support section 55 are indicated by two-dot-dash lines in order to show positional relationship among the addition device 50A, the sound board 7, the bridge 6 and the support section 55. Further, in FIG. 26, the state where the magnetic circuit member 52 is supported by the support section 55 is shown as viewed in such a direction where the width direction A4 of the bridge 6 corresponds to a left-right direction of the figure. The bridge 6 is mounted on the upper surface 7A of the sound board 7. Further, the vibration area C1 is preset on the lower surface 7B of the sound board 7, as noted above. Note that the support section 55 has a suitable opening 55*a* formed therein such that a screwdriver held in a human operator's hand can be inserted into the opening 55*a* from below during the attachment operations.

The top plate has a not-shown hole portion extending therethrough from the upper surface to the lower surface, and a female thread formed in the inner surface of the hole. Similarly, the support section 55 has a not-shown hole portion extending therethrough from the upper surface to the lower surface, and a female thread formed in the inner surface of the hole. Like in the above-described first embodiment, the magnetic circuit member 52 is fixed to the support section 55 by a combination of the plurality of support rods 551 each having male threads formed on opposite end portions thereof and the nuts 552 screwed on the respective male threads of the support rods 551. Thus, like in the above-described first embodiment, the load of the magnetic circuit member 52 supported by the support section 55 acts on the vertical strut 9 via the support section 55.

Then, when the human operator performs the operation of step S23, the vibration member 51 is prevented from moving downward of the position where the lower surface 512B of the cap 512 contacts the upper surface 54A of the fixing jig 54 by means of the fixing jig 54, i.e. where coil length middle and the magnetic path width middle substantially coincide with each other, as noted above. By thus preventing formation of a gap between the lower surface 512E and the upper surface 54A, the human operator allows the magnetic circuit member 52 to be supported by the support section 55 in such a manner that a relative position, in the normal line direction A1, of the vibration member 51 to the magnetic circuit member 52 has predetermined relationship.

Referring, back to FIG. 24, the human operator then removes or dismount the fixing jig 54 (step S24). Then, the human operator moves the fastening member (e.g., wood screw), provided for fixing the cap 512 to the sound board 7, to a mounting position of the cap 512 where the fastening member (e.g., wood screw) should be fastened (step S25) and then fastens the fastening member to the mounting position and to the sound board 7 to thereby fix the cap 512 to the sound board 7 (step S26). Step S25 is an example of a "movement step" in the present invention, and step S26 is an example of a "fixation step" in the present invention. Details of the operations performed by the human operator at steps S25 and S26 will be described below with reference to FIG. 27.

Figure 27:
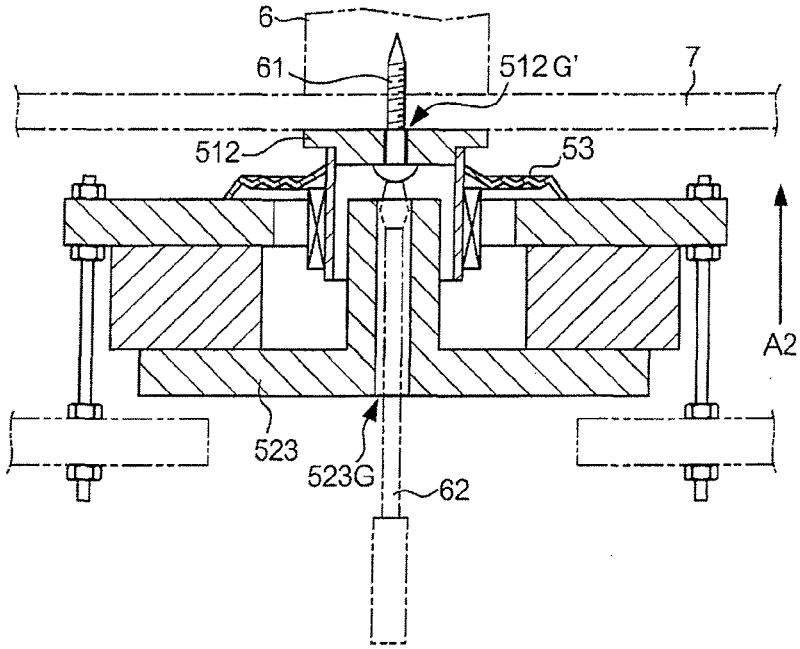
FIG. 27 is a view showing the cap fixed to the sound board.

FIG. 27 is a view showing the cap 512 fixed to the sound board 7. More specifically, the cap 512 is fixed to the sound board 7 by means of the wood screw 61 that is a fastening member fastened through the hole portion 512G to the sound board 7. The wood screw 61 is formed of non-magnetic metal, such as brass or stainless steel, and includes a head portion having a greater diameter than the hole portion 512G of the cap 512. Here, the "non-magnetic metal" is substance other than ferromagnetic substance. The wood screw 61 is screwed through the hole portion 512G to the sound board 7 and then into the bridge 6. The cap 512 is fixed to the sound board 7 by being pressed against the sound board 7 via the head portion. Further, a part of an externally-threaded portion of the wood screw 61 closer to the head portion (i.e., the root of the wood screw 61) has a diameter matching the diameter of the hole portion 512G. Thus, in the state of FIG. 27, the root of the wood screw 61 is accurately snugly fitted in the lower end opening of the hole portion 512G. Namely, the cap 512 is fixed at one position relative to the position where the wood screw 61 is screwed into the sound board 7 and the bridge 6.

The screwdriver 62 is formed of non-magnetic metal, such as brass or stainless steel, and the distal end of the screwdriver 62 has a shape corresponding to a shape of a tapped hole of the wood screw 61. For example, if the wood screw 61 is a cross-head screw having a "+" tapped hole, the distal end of the screwdriver 62 has a "+" shape, but, if the wood screw 61 is a slotted-head screw having a "−" tapped hole, the distal end of the screwdriver 62 has a "−" shape. At step S25, the human operator uses the screwdriver 62 to perform the operation. Namely, with the wood screw 61 fitted in the distal end of the screwdriver 62, the human operator inserts the distal end of the screwdriver 62 into the hole portion 523G extending through the yoke 523. Before the wood crew 61 of FIG. 23 is fastened through the hole portion 512G to the sound board 7, the axis line B2 of the bobbin 511 and the axis line B3 of the circular columnar portion 523F are in alignment with (substantially coincident with) each other for connection via the damper 53. Thus, the axis line of the hole portion 512G of the cap 512 is substantially coincident with the axis of the hole portion 523G. The human operator uses the screwdriver 62 to move the wood screw 61, inserted into the hole portion 523G until the wood screw 61 passes through the hole portion 523G to reach the hole portion 512G.

Then, once the wood screw 61 passes through the hole portion 512G into contact with the sound board 7, the human operator rotates the screwdriver 62 to screw the wood screw 61 into the sound board 7. During that time, the driver 62 and the wood screw 61 substantially align with each other in the axial direction, because the screw driver 62 turns the wood screw 61 while continuing to push the wood screw 61. Thus, the wood screw 61 is fastened to the hole portion 512G and the sound board 7. Further, the cap 512 is fixed at one position relative to the position where the wood screw 61 is screwed into the sound board 7 and the bridge 6 as noted earlier, and thus, even if the axis line B1 of the hole portion 512G and the axis line B3 of the yoke 523 are in misalignment with each other when the operation of step S25 is to be stared, the root of the wood screw 61 will accurately snugly fitted in the lower end opening of the hole portion 512G as the wood screw 61 is screwed into the sound board 7. As a consequence, the hole portion 512G and the hole portion 523G will axially align in a straight line, and thus, the axis line B1 of the hole portion 512G and the axis line B3 of the yoke 523 will axially align with each other. Also, the axis line B1 axially aligns with the axis line B2 of the bobbin 511. Namely, by the human operator performing the operation of step S25, the bobbin 511 and the yoke 523 are brought into axis alignment with each other. Thus, the human operator can attach the vibration device 50A in such a manner that the bobbin 511 and the yoke 523 do not contact each other. Further, when the vibration member 511 vibrates, the bobbin 511 and the yoke 523 are less likely to contact each other as compared to the where the bobbin 511 and the yoke 523 are not in axis alignment with each other.

When an object is to be moved through the hole portion 523G to reach the hole portion 512G, the object and a tool for moving the object both pass through the magnetic path formed by the magnetic circuit member 52. If the object and the tool are formed of magnetic material, they are attracted to the yoke 523 by attractive force produced by the magnetic path, so that it becomes difficult to move them. On the other hand, the wood screw 61 and the screwdriver 62 are both formed of non-magnetic material as noted above, and thus, force which they receive due to the magnetism of the magnetic path when they pass through the two hole portions is so small to ignore. Therefore, the human operator can perform the operation of step S25 without minding force which the wood screw 61 and the screwdriver 62 receive from the magnetic force. In this manner, the cap 512 is fixed to the sound board 7 as shown in FIG. 27.

Thus, as the bobbin 511 moves upward, the sound board 7 is pressed upward. But, as the as the bobbin 511 moves downward, the sound board 7 is pulled downward instead of the bobbin 511 getting away from the sound board 7. In this manner, vibration of the bobbin 511 is transmitted to the bridge 6 via the sound board 7 and then to the string set 5.

The bobbin 511 and the cap 512 together constitute an example of a "bobbin section" in the present invention, and the wood screw 61 is an example of a "fixation member" in the present invention. Further, the cap 512, which covers one end of the bobbin section, is an example of a "lid section" in the present invention. As noted earlier, the bobbin section is fixed at one end to the sound board 7 by means of the fixation member of non-magnetic material. Further, the magnetic circuit member 52 functions as a magnetic path formation section that forms the magnetic path space 525 between inside the inner peripheral surface 511C of the bobbin section and outside the outer peripheral surface 511D of the bobbin section shown in FIG. 5. Further, the hole portion 523G formed in the yoke 523 of the magnetic circuit member 52 is an example of a "hole" in the present invention. As shown in FIG. 23, the hole portion 523G extends through the magnetic path formation section in the axial direction A3 and has one end portion opening from the circular columnar portion 523F into the inner space of the bobbin section of the magnetic path formation section. The circular columnar portion 523F is a portion located inwardly of the bobbin section of the magnetic path formation section. Further, the axial direction A3 is an example of a "first direction" in the present invention. Further, the hole portion 523G has a size to permit passage therethrough of the wood screw 61 as noted above in relation to step S25 of FIG. 6. The bobbin section (more specifically, the cap 512 thereof) has the hole portion 512G extending therethrough in the axial direction A3. The hole portion 512G, which also indicates that it is a position to which the wood screw 61 should be fastened, is an example of a "designated region" in the present invention. When the hole 512G is in alignment with the hole portion 523G in the axial direction A3, it is indicated that the bobbin section and the magnetic path formation means are in a state where they do not contact each other as seen in FIG. 10.

Because the magnetic circuit member 52 is fixed in position by being supported by the support section 55, most of the drive force produced by the voice coil 513 is used as thrust force for vibrating the bobbin 511. Further, the magnetic circuit member 52 is supported by the support section 55 in spaced-apart positional relation to the vibration member 51 and in such a manner as to not contact with the sound board 7. Further, because the vibration member 51 is spaced from the magnetic circuit member 52, the vibration member 51 is supported by the sound board 7 by being fixed to the sound board 7. By the vibration device 50A being supported by the support section 55 in the aforementioned manner, no load other than that of the vibration member 51 acts on the sound board 7. The support section 55 may support the magnetic circuit member 52 in any other desired manner than the aforementioned as long as no load other than that of the vibration member 51 is applied to the sound board 7. Like in the above-described first embodiment, the support section 55 may support the magnetic circuit member 52 in any other desired manner than the aforementioned as long as no load other than that of the vibration member 51 acts on the sound board 7.

In the second embodiment, there may be employed a control system similar in function and construction to the functional arrangements of the control device 10 and grand piano 1 in the first embodiment shown in FIGS. 14 and 15.

[Modifications of the Second Embodiment]

The above-described is only one example of the second embodiment of the present invention, and the second embodiment may be modified variously as follows. Further, the above-described embodiment and the following modifications may be practiced in combination as necessary.

<Modification 12>

Whereas the cap 512 in the second embodiment has been described as fixed to the sound board 7 by means of the wood screw 61 as the fixation member, any other suitable fixation members may be used. For example, the cap 512 may be fixed to the sound board 7 by means of a bolt and a nut, a nail or an adhesive agent. Desirably, the cap 512 is fixed at its central portion by means of a wood screw passed through the hole portion 512G' and fixed at an outer peripheral end region of the upper surface 512A by means of an adhesive agent. Force pulling downward the bobbin 512 is applied by the bobbin 511 to the outer peripheral end region of the upper surface 512A. By fixing such an outer peripheral end region of the upper surface 512A in the aforementioned manner, it is possible to prevent the outer peripheral end region of the upper surface 512A from floating off the sound board 7.

<Modification 13>

As another modification, a washer may be used in fixing the cap 512 to the sound board 7 by means of the wood screw 61. In such a case, the washer is positioned beneath the cap

512, and the wood screw 61 is passed through the washer and the hole portion 512G' to be screwed into the sound board 7. Thus, the wood screw 61 can be made less likely to come loose as compared to a case where no such washer is used.

<Modification 14>

Figure 28:
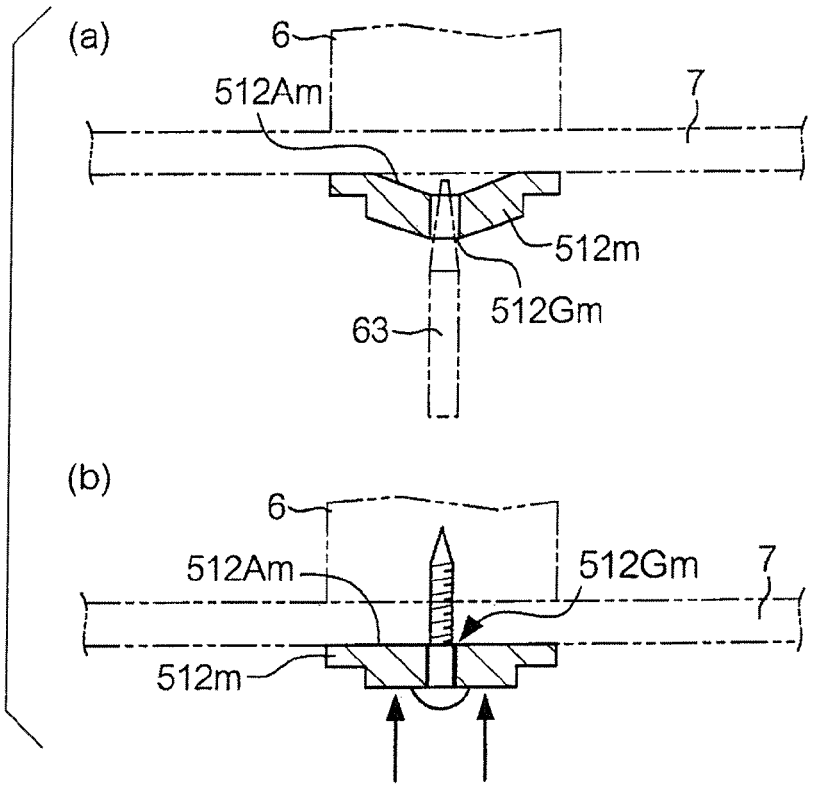
FIG. 28 is a view showing a modified cap.

As still another modification, the cap mounted on the bobbin 511 may have a different shape from the cap 512 in the above-described embodiment. FIG. 28 is a view showing an example of the modified cap 512*m*. (a) of FIG. 28 shows a state before the cap 512*m* is fixed to the sound board 7 by means of the wood screw 61. The cap 512*m* has a shape gradually dented downward in a direction from an outer peripheral portion to a central portion. (b) of FIG. 28 shows the cap 512*m* fixed to the sound board 7 by means of the wood screw 61 passed through the hole portion 512Gm into the sound board 7. By the wood screw 61 pressing the cap 512*m* against the sound board 7, the downwardly dented central portion of the cap 512*m* is uplifted in a direction of arrows into contact with the sound board 7.

For example, let it be assumed here that the cap is fixed to the sound board 7 by means of an adhesive agent and the wood screw 61 as noted above in relation to Modification 12. In this case, the human operator fixes the magnetic circuit member 52 to the support section 55 at step S23 of FIG. 24 and then uses an adhesive-pouring tool 63, shown in two-dot-dash line, to pour an adhesive agent through the hole portion 512Gm into a space between the cap 512*m* and the sound board 7 placed in the state shown in (a) of FIG. 28. Then, the human operator presses the cap 512*m* against the sound board 7 by use of the wood screw 61 at step S15 as shown in (b) of FIG. 28. At that time, the poured adhesive spreads between the upper surface 512Am of the cap 512*m* and the sound board 7. In this manner, the human operator fixes the cap 512*m* to the sound board 7 by means of the wood screw and the adhesive agent. According to this modification, even in a case where the cap 512*m* is fixed by means of the wood screw and the adhesive agent, the human operator can cause the magnetic circuit member 52 to be supported by the support section 55 without minding an exact position of the cap 512*m*, by performing the operations without applying the adhesive agent to the upper surface 512Am till step S24. Further, after causing the magnetic circuit member 52 to be supported by the support section 55, the human operator can easily apply the adhesive agent at step S15 as compared to a case where, for example, the tool 63 is inserted from a lateral side into a gap between the sound board 7 and the upper surface 512Am to apply the adhesive agent all over the upper surface 512Am.

Figure 29:
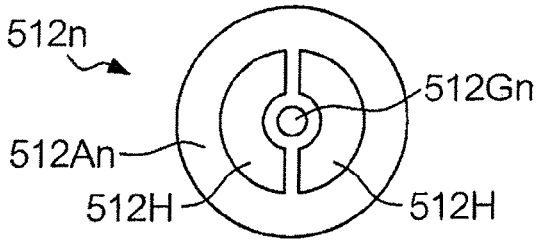
FIG. 29 is a view showing a modified cap.

Further, whereas the second embodiment has been described above as using the cap 512 mounted on the end of the bobbin 511, what is mounted on the end of the bobbin 511 is not limited to the cap or other member of a shape closing the end opening of the bobbin. FIG. 29 is a view showing an example of the member 512*n* mounted on the end of the bobbin 511. The member 512*n* has the upper surface 512An. Specifically, FIG. 29 shows the member 512*n* as viewed from over the upper surface 512An. The member 512*n* has a hole portion 512G and opening regions 512H shaped to surround the outer periphery of the hole portion 512Gn. As the member 512*n* is mounted on the upper end of the bobbin 511, the interior of the bobbin 511 opens to outside the bobbin 511 through the opening regions 512H. The member 512*n* may be fixed to the sound board 7, for example, by the wood screw 61 fastened to the hole portion 512Gn and the sound board 7 and the adhesive agent applied to the upper surface 512An. In short, it suffices that the member mounted on the bobbin 511 be one having a hole for fitting therein the wood screw 61, such as the above-described cap 512 or the member 512*n*.

Figure 30:
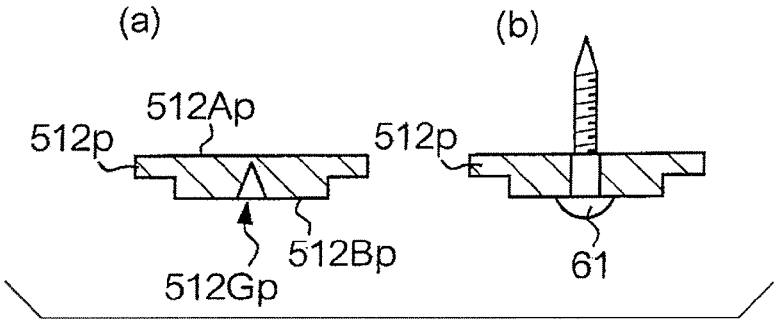
FIG. 30 is a view showing a modified cap.

Further, whereas the hole portion 512G' in the second embodiment has been described above as extending axially through the cap 512, it need not necessarily extend axially through the cap 512. FIG. 30 is a view showing an example of such a modified cap 512*p*. (a) of FIG. 30 shows the cap 512*p* before the wood screw 61 is fitted in the cap 512*p*. The cap 512*p* has a hole portion 512Gp formed therein to extend from the lower surface 512Bp to a position short of the upper surface 512Ap. The hole 512Gp is formed by denting the lower surface 512Bp in a conical shape and extends short of the upper surface 512Ap. A portion of the cap 512*p* from the bottom of the hole portion 512Gp to the upper surface 512Ap has such a thickness that, by the human operator screwing the distal end of the wood screw 61 into the resin of the bottom to form an additional hole, the hole portion 512Gp can be extended through the additional hole to the upper surface 512Ap. In short, the hole portion of the cap need not necessarily extend through the cap as long as it can function as a mark indicating that the hole portion is a position where the wood screw 61 is to be fitted or fastened and can fix the cap to the sound board 7 by fitting therein the wood screw 61. The aforementioned cap 512*m*, the member 512*n* or cap 512*p*, and the bobbin 511 constitute an example of the "bobbin section" in the present invention.

<Modification 15>

In the above-described second embodiment, the human operator merely positions the upper surface 512A of the cap 512 in contact with the sound board 7 at step S22 of FIG. 24. As a modification, however, there may be used an adhesive agent that takes time before curing to a degree where the position of the upper surface 512A contacting the sound board 7 can be shifted if desired, until the time required for the operations of steps S23 to S25 elapses. Even before completely curing, this adhesive agent fixes the cap 512 to such a degree where the position of contact between the upper surface 512A and the sound board 7 would not be shifted, for example, by force applied due to flexure of the damper 53. In this manner, the position of contact between the upper surface 512A and the sound board 7 can be preventing from shifting due to mere slight inclination of the magnetic circuit member 52 during the operation of step S23, so that the human operator can perform the operation for fixing the magnetic circuit member 52 to the support section 55 with an increased ease.

<Modification 16>

The bobbin 511 and the cap 512 in the above-described second embodiment may be formed of material different from the aforementioned. For example, whereas the bobbin 511 has been described as formed of metal aluminum material, it may be formed of any other material, such as copper, resin, plastic or the like. Further, whereas the cap 512 has been described as formed of resin, it may be formed of metal, such as aluminum material or copper, plastic or the like. In any case, any desired material may be used as long as the material satisfies conditions required of the voice coil type actuator, such as strength, weight, non-magnetic/magnetic property, absence/presence of heat resistant property, etc.

<Modification 17>

As still another modification, the magnetic circuit member 52 may be fixed to the support section 55 in a manner from the above-described manner. For example, through-holes may be formed in the yoke 523, not in the top plate 521, to extend through the thickness, i.e. from the upper surface to the lower surface, of the yoke 523, so that the magnetic circuit member 52 can be supported by the support section 55 by means of the support rods 551 and the plurality of nuts 552. Further, although the magnetic circuit member 52 is supported out of contact with the support section 55 in the illustrated example of FIG. 26, it may be supported in contact with the support section 55. In such a case, the position, in the axial direction A2, of the support section 55 may be made adjustable, so that, by adjusting the position (height position) in the axis direction A2 of the support section 55, the vibration device 50A can be attached to the sound board 7 with the relative positions relative (height) positions), in the axial direction A2, of the vibration member 51 and the magnetic circuit member 52 maintained in an ideal state.

<Modification 18>

Figure 31:
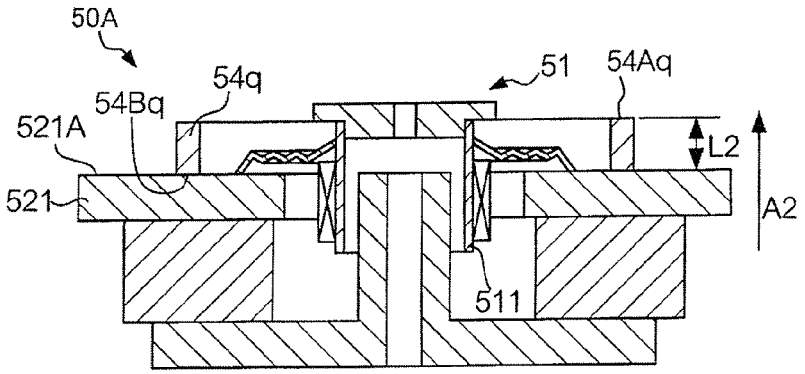
FIG. 31 is a view showing a modified fixing jig mounted in place.

In the second embodiment, like in Modification 1 of the first modification, the fixing jig may have a different shape from the above-described fixing jig 54, and a fixing jig similar to the fixing jig 54*q* shown in FIG. 16 may be used in the second embodiment. FIG. 31 shows an example where a fixing jig similar to the fixing jig 54*q* is used in the second embodiment. In this case, at step S23 of FIG. 24, the human operator causes the magnetic circuit member 52 to be supported by the support section 55, while visually checking their positions, in such a manner that the upper end of the bobbin 511 is brought into alignment with the upper surface 54Aq of the fixing jig 54*q* with the upper surface 512A of the cap 512 contacting the sound board 7. In this manner, the human operator can make setting such that the coil length middle and the magnetic path width middle substantially coincide with each other, i.e. relative positions of the vibration member 51 and the magnetic circuit member 52 have the above-mentioned desired relationship.

Further, as noted above, the fixing jig mounted to the magnetic circuit member 52 need not necessarily have the height L2 from the upper surface 512A; for example, the fixing jig may be mounted to the magnetic circuit member 52 in such a manner that the upper surface 512A of the cap 512 is at the height L2 from the top plate 521 (upper surface 521A), or a mark put somewhere on the vibration member 51 is at the height L2 from the upper surface 521A. In short, the fixing jig may be at any desired height from the upper surface 521A as long as the height can function as a reference for the human operator to visually check a position of the vibration member 51 when the coil length middle and the magnetic path width middle substantially coincide with each other.

<Modification 19>

Figure 32:
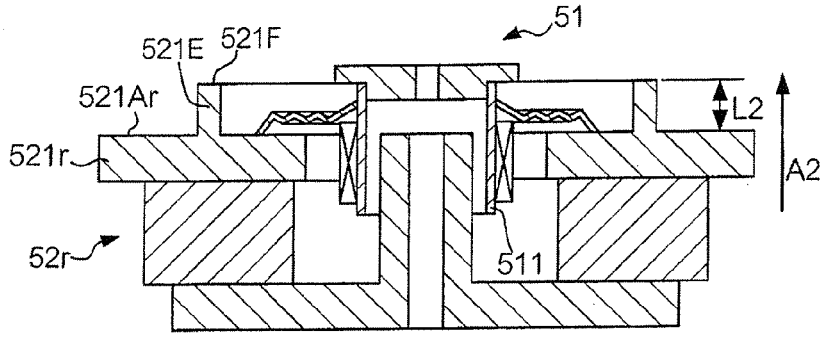
FIG. 32 is a view showing a modified vibration device.

In the second embodiment, the fixing jig may be dispensed with; instead, the magnetic circuit member 52 may include a portion formed thereon so as to permit checking of the position of the vibration member 51 when the coil length middle and the magnetic path width middle are substantially coincident with each other, like in Modification 2 (FIG. 17) of the first embodiment. FIG. 32 is a view showing a modified magnetic circuit member 52*r* whose top plate 521*r* has an upper surface 521Ar and a projecting portion 521E formed on the upper surface 521Ar and having the height L2 from the upper surface 521Ar. In this case, the human operator at step S23 of FIG. 24 causes the magnetic circuit member 52 to be supported on the support section 55 while making adjustment such that the upper end of the bobbin 511 is located at a position along (in alignment with) the upper surface 521F of the projecting portion 521E.

<Modification 20>

Figure 33:
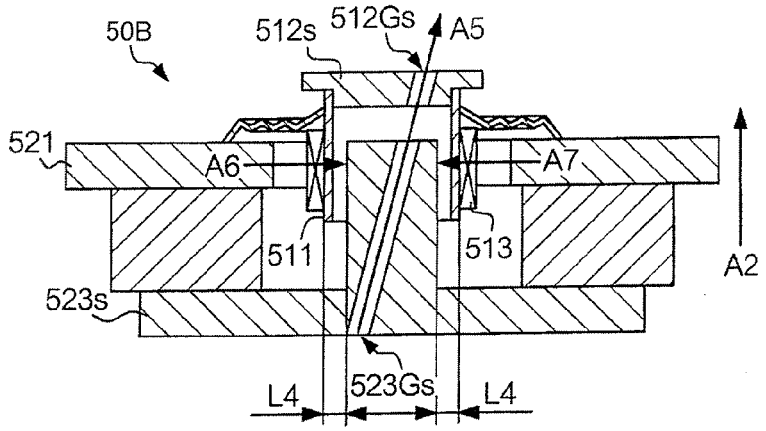
FIG. 33 is a view showing a modified vibration device.

In the above-described second embodiment, the hole portion 512G' and the hole portion 523G extend through the cap 512 and the yoke 523, respectively, in the axial direction A2, they may extend through the cap 512 and the yoke 523, respectively, in a different direction from the above-described. FIG. 33 is a view showing such a modified vibration device 50B. The vibration device 50B includes a cap 512*s* and a yoke 523*s*. The cap 512*s* has a hole portion 512Gs, and the yoke 523*s* has a hole portion 523Gs. The hole portion 512Gs and the hole portion 523Gs extend in a direction A5 at an angle to the axial direction A2. In FIG. 33, a distance between magnetic flux line directions A6 and A7 that are directions of lines of magnetic flux of the bobbin 511 and the yoke 523 (i.e., directions indicated by broken lines in FIG. 23) is L4. This represents a state where the bobbin 511 and the yoke 523 are in axis alignment as shown in FIG. 23. In this state, the hole portion 512Gs of the cap 512 is formed to extend obliquely in alignment with the direction A5 of the hole portion 523Gs. The hole portion 523Gs is an example of a "hole portion" in the present invention. Further, of the hole portion 512Gs, an opening appearing in the upper surface of the cap 512 is an example of a "designating region" in the present invention. Further, the direction A5 is an example of the "first direction" in the present invention. In the aforementioned manner, the cap 512*s* can be fixed to the sound board 7 with the screwdriver 62 and the wood screw 61 of FIG. 27 passed obliquely through the hole portions 512Gs and 523Gs so that the hole portions 512Gs and 523Gs axially align with each other in a straight line.

<Modification 21>

Figure 34:
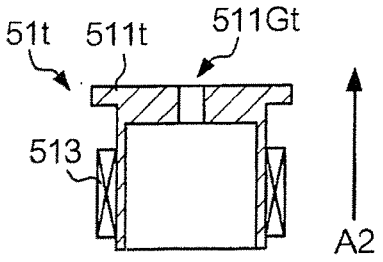
FIG. 34 is a view showing a modified vibration member.

Whereas the second embodiment has been described above in relation to the case where the cap 512 is mounted on the upper end of the bobbin 511, the bobbin 511 itself may be shaped to include the cap 512. FIG. 34 is a view showing such a modified vibration member 51*t*, which includes a bobbin 511*t* and the voice coil 513. The bobbin 511*t* is formed of aluminum material and shaped to correspond to a combination of the shapes of the bobbin 511 and cap 512 shown in FIG. 23. The bobbin 511*t* has a hole portion 511Gt extending through an upper end portion thereof in the axial direction A2. The bobbin 511*t* is an example of the "bobbin section" in the present invention.

<Modification 22>

As still another modification, the magnetic circuit member 52 may be supported by the support section 55 in a manner from the above-described manner. For example, through-holes may be formed in the yoke 523, not in the top plate 521, to extend through the thickness, i.e. from the upper surface to the lower surface, of the yoke 523, so that the magnetic circuit member 52 can be supported by the support section 55 by means of the support rods 551 and the plurality of nuts 552. Further, although the magnetic circuit member 52 is supported out of contact with the support section 55 in the illustrated example of FIG. 26, it may be supported in contact with the support section 55. Further, whereas the support section 55 is fixed to the casing of the grand piano 1 in the above-described embodiment, it may be fixed to any other suitable part than the grand piano casing, such as the ground surface (floor). In any case, it just suffices for the magnetic circuit member 52 to be supported in such a manner that the distance from the bobbin 511 to the sound board 7 falls within the aforementioned end moving range.

<Modification 23>

Whereas the vibration member 51, the magnetic circuit member 52 and the damper 53 each have a circular shape as viewed in the normal line direction A1 shown in FIG. 23, the present invention is not so limited, and the vibration member 51, the magnetic circuit member 52 and the damper 53 may have any other shape, such as an elliptical or square shape. In short, the vibration member 51, the magnetic circuit member 52 and the damper 53 may be of any desired shape as long as the vibration member 51 vibrates in accordance with a waveform indicated by a drive signal input to the voice coil. Even in such a case, a portion disposed inside the bobbin section of the magnetic path formation section like the aforementioned circular cylindrical portion 523F is sized so that it can be disposed in such a manner to not contact the inner peripheral surface of the bobbin section, and a portion disposed outside the bobbin section of the magnetic path formation section like the aforementioned yoke 524 is sized so that it can be disposed in such a manner to not contact the outer peripheral surface of the bobbin section.

<Modification 24>

The end member (cap 512) mounted on the end of the bobbin 511 and suited for connection to the sound board 7 need not necessarily be a flat plate-shaped cap as set forth above. For example, the end member may be in the form of an elongated hollow rod projecting to some extent upward from the distal end of the bobbin 511. In such a case, the hollow rod has a hole portion 512G' formed in a closed distal end surface for passage therethrough of a screw. Thus, the wood screw 61 that is a fixation member can pass through the hollow rod to reach the distal end hole portion 512G'.

[Third Embodiment of the Vibration Device]

Figure 35:
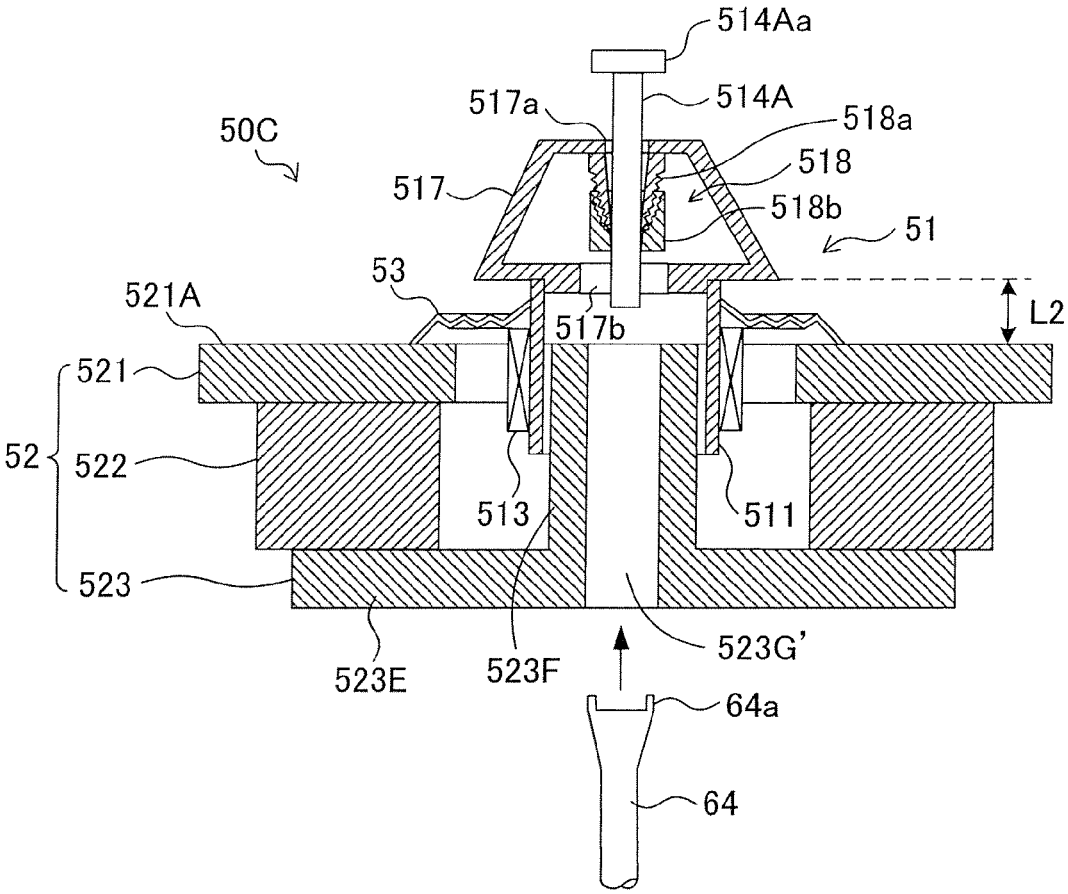
FIG. 35 is a vertical sectional view of a third embodiment of the vibration device of the present invention.

FIG. 35 is a vertical sectional view of a third embodiment of the vibration device 50C. The third embodiment of the vibration device 50C has a mounting-length-adjustable connecting shaft 514A for mounting the connection member 51 to the sound board 7, which is different in construction from the shaft 514 provided in the first embodiment of the vibration device 50. The construction of the third embodiment of the vibration device 50C for performing its primary function as a vibration device may be similar to that of the first or second embodiment of the vibration device 50 or 50A. Thus, in the following description and drawings pertaining to the third embodiment, similar elements to the first or second embodiment are indicated by the same reference numerals as used in the first or second embodiment and will not be described here to avoid unnecessary duplication.

In FIG. 35, a housing formed of non-magnetic material (aluminum, synthetic resin or the like) 517 is joined to the upper end of the bobbin 513 of the voice coil 511. The housing 517 has upper and lower openings 517*a* and 517*b*, and a chuck 518 provided therein. The chuck 518 has a male thread portion 518*a* and a female thread portion 518*b*. The chuck 518 has an axial central through-hole for passage therethrough of a shaft 514A that is an object to be chucked by the chuck 518. The male thread portion 518*a* is fixed within the housing 517, and the female thread portion 518*b* is held in meshing engagement with the male thread portion 518*a* in such a manner that the through-hole of the chuck 518 aligns with the upper opening 517*a*. As known in the conventional chucks, the male thread portion 518*a* has a plurality of axial cuts, and, in response to tightening by the female thread portion 518*b*, the inner through-hole decreases in its diameter to clamp the shaft passed through the through-hole. The lower opening 517*b* of the housing 517 has a size suitably larger than the diameter of the chuck 518 so that the chuck 518 can be put inside the housing 517 during assembly. Further, the lower opening 517*b* is sized to allow a driver 64, provided for turning the female thread portion 518*b* of the chuck 518, to enter through the lower opening 517*b*. Note that the chuck 518 has a key groove formed, in the lower surface of the female thread portion 518*b*, for fitting engagement with a distal end key portion 64*a* of the driver 64. Thus, the female thread portion 518*b* of the chuck 518 can be turned by the driver 64 with the distal end key portion 64*a* in the key groove.

Further, with the chuck 518 in a loosened state, the connecting shaft 514A can be introduced into the housing 517 through the upper opening 517*a* of the housing 517. Further, with the chuck 518 in the loosened state, the connecting shaft 514A can be freely moved; thus, by setting the connecting shaft at a desired length and then tightening the chuck 518, the connecting shaft 514A can be fixed with a desired projecting length. Thus, an upper end portion of the shaft 514 is constructed to function as a connecting portion 514Aa, and this connecting portion 514Aa is connected to the sound board 7 by an adhesive agent or the like.

Like in the second embodiment, the yoke 523 in the third embodiment of the vibration device 50C has a through-hole portion 523G' extending through both of the disk portion 523E and the circular columnar portion 523F in the axial direction. The driver 64 is inserted from below upward through the through-hole portion 523G' into the vibration device 50C so that the female thread portion 518*b* of the chuck 518 can be turned by means of the driver 64.

The following describe one example sequence of operations for attaching the third embodiment of the vibration device 50C to the piano 1. First, the support section 55 is mounted at a predetermined position in a manner to the aforementioned manner. Then, the connecting shaft 514A is mounted singly at a predetermined position on the lower surface of the sound board 7. Namely, the connecting portion 514Aa is fixedly connected to the sound board 7 by an adhesive agent or the like. Then, the vibration device 50C is installed on the support section 55 in a manner similar to the aforementioned. At the same time, the lower end of the connecting shaft 514A is inserted into the chuck 518 through the upper opening 517*a* of the housing 517. Then, the driver 64 is inserted from below upward into the through-hole portion 523G' of the yoke 523 from below, and the distal end key portion 64*a* of the driver 64 is fitted into the key groove and turned to fasten the chuck 518 and thereby fix the connecting shaft 514A in position. Note that, at that time, the aforementioned fixing jig (54, 54*q* or the like) may or may not be used. The bobbin 511 can be set at a predetermined reference mounting position (at an ideal neutral position) by being held by the damper 53 (i.e., the distance L2 from the upper surface 521A of the top plate 521 to the upper end of the bobbin 511 can be set at the aforementioned ideal distance). Thus, ideal coil positioning can be achieved without the aforementioned fixing jig (54, 54*q* or the like) being used. Needless to say, the driver 64 is pulled out of the through-hole portion 523G' after completion of the tightening of the chuck 518. As compared to the case where the operations for adjusting the length of the shaft 514 and fastening the shaft 514 by accessing from a lateral side, the aforementioned approach of accessing from below for the tightening operation can be applied advantageously under an environment where accessing from a lateral side is difficult.

The third embodiment may be summarized as follows. The connecting shaft 514A, the housing 517 and the chuck 518 correspond to a connection member that is connected to the bobbin 511 and vibrates in response to vibration of the bobbin 511. Such a connection member includes the connecting portion 514Aa (connection end) suited for connection to the sound board 7 of the musical instrument and is adjustable in length. Namely, the connection member includes: the housing 517 (first member) connected to the bobbin 511; the connecting shaft 514A (second member) connected to the housing 517 (first member) in such a manner that it is displaceable relative to the housing 517 (first member); and the chuck 518 (tightening tool) adapted to tighten and fix a connected portion between the first member and the second member.

[Fourth Embodiment of the Vibration Device]

Figure 36:
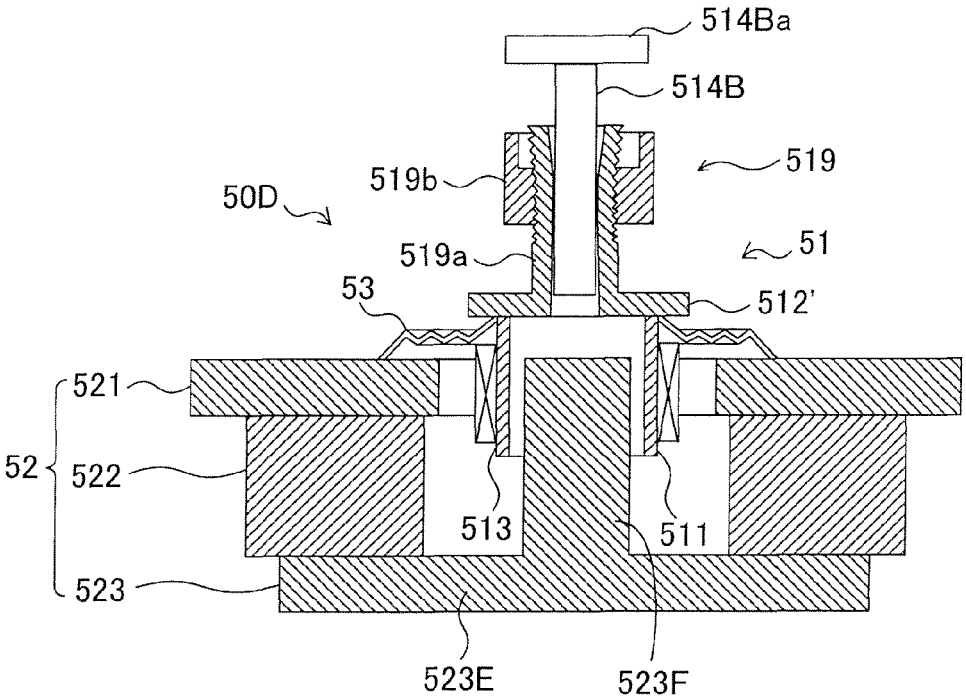
FIG. 36 is a vertical sectional view of a fourth embodiment of the vibration device of the present invention.

FIG. 36 is a vertical sectional view of a fourth embodiment of the vibration device 50D. The fourth embodiment of the vibration device 50D has a mounting-length-adjustable connecting shaft 514B for mounting the connection member 51 to the sound board 7, which is different in construction from the shafts 514 and 514A provided in the above-described first and third embodiments of the vibration device 50 and 50D. The fourth embodiment is similar to the third embodiment in that the chuck 519 is used to adjust the length of the shaft 514B but different from the third embodiment in terms of the construction of the chuck. In the following description and drawings pertaining to the fourth embodiment, similar elements to the first to third embodiments are indicated by the same reference numerals as used in the first to third embodiments and will not be described here to avoid unnecessary duplication.

In FIG. 36, a cap 512' formed of non-magnetic material (aluminum, synthetic resin or the like) is joined to the upper end of the bobbin 513 of the voice coil 511. A male thread portion 519*a* of the chuck 519 is joined to the upper surface of the chuck 512'. The cap 512' and the male thread portion 519*a* of the chuck 519 may be formed integrally with each other, or formed as separate component parts and then interconnected with each other. A female thread portion 519*b* is held in meshing engagement with the male thread portion 519*a* of the chuck 519. The chuck 519 has an axial central through-hole for passage therethrough of a shaft 514B that is an object to be chucked, and this axial central through-hole is in communication with the hole portion of the cap 512. Thus, the lower end of the shaft 514B can pass through the axial central through-hole to project downward beyond the lower surface of the cap 512', as necessary. The connecting shaft 514B can be inserted into the chuck 519 through the upper opening of the chuck 519. For example, a distal end region of the male thread portion 519*a* has a plurality of axial cuts formed therein and resiliently flares slightly radially outward. As the female thread portion 519*b* is turned to tighten the chuck, the female thread portion 519*b* moves upward to press the distal end region of the male thread portion 519*a* radially inward and thereby reduce the diameter of the axial central through-hole, so that the shaft passed through the axial central through-hole is tightened.

With the chuck 519 in the loosened state, the shaft 514B can be freely moved. Thus, by setting the shaft 514B at a desired height (length) projecting from the upper surface of the cap 512' and then tightening the chuck 519, the shaft 514B can be fixed with a desired projecting height (length). Thus, an upper end portion of the connecting shaft 514B is constructed to function as a connecting portion 514Ba, and this connecting portion 514Ba is connected to the sound board 7 by an adhesive agent or the like.

The following describe one example sequence of operations for attaching the fourth embodiment of the vibration device 50D to the piano 1. First, the support section 55 is mounted at a predetermined position in a similar manner to the aforementioned. Then, the vibration device 50D having the connecting shaft 514B attached thereto with the chuck 519 in the loosened state is installed on the support section 55 in a manner similar to the aforementioned. At that time, the upper end portion 514Ba of the connecting shaft 514B is positioned to correspond to a predetermined mounting position on the lower surface of the sound board 7. Then, the shaft 514B is moved upward and fixedly connected to the sound board 7 by means of an adhesive agent or the like. Then, the chuck 519 is tightened to fix the connecting shaft 514B in position. Note that, at that time, the aforementioned fixing jig (54, 54*q* or the like) may or may not be used. The bobbin 511 can be set at a predetermined reference mounting position (at an ideal neutral position) by being held by the damper 53. Thus, ideal coil positioning can be achieved without the aforementioned fixing jig (54, 54*q* or the like) being used.

As a modification of the fourth embodiment, the orientation of the chuck 519 may be reversed up and down. Namely, the shaft 514B having the upper-end connecting portion 514Ba is formed in a cylindrical shape having an inner through-hole, and the male thread portion 519*a* of the chuck 510 is formed on a lower portion of the cylindrical shaft 514B in a downward orientation opposite from the orientation shown in FIG. 36. Then, a rod is provided to project upward beyond the upper surface of the cap 512', and this rod is inserted through the through-hole of the chuck 519. In this manner, the upwardly-projecting rod and the shaft 514B are interconnected via the chuck 519 in such a manner that the shaft 514B can be adjusted in height.

The fourth embodiment may be summarized as follows. The connecting shaft 514B, the chuck 519 and the cap 512' correspond to a connection member that is connected to the bobbin 511 so as to vibrate in response to vibration of the bobbin 511. Such a connection member includes the connecting portion (connection end) 514Ba suited for connection to the sound board 7 of the musical instrument and is adjustable in length. Namely, the connection member includes: the cap 512' and the male thread portion (first member) 519*a* joined to the bobbin 511; the connecting shaft (second member) 514B joined to the cap 512' and the male thread portion (first member) 519*a* in such a manner that it is displaceable relative to the cap 512' and the male thread portion (first member) 519*a*: and the chuck (tightening tool) 519 adapted to tighten and fix a connected portion between the first member and the second member.

[Fifth Embodiment]

Figure 37:
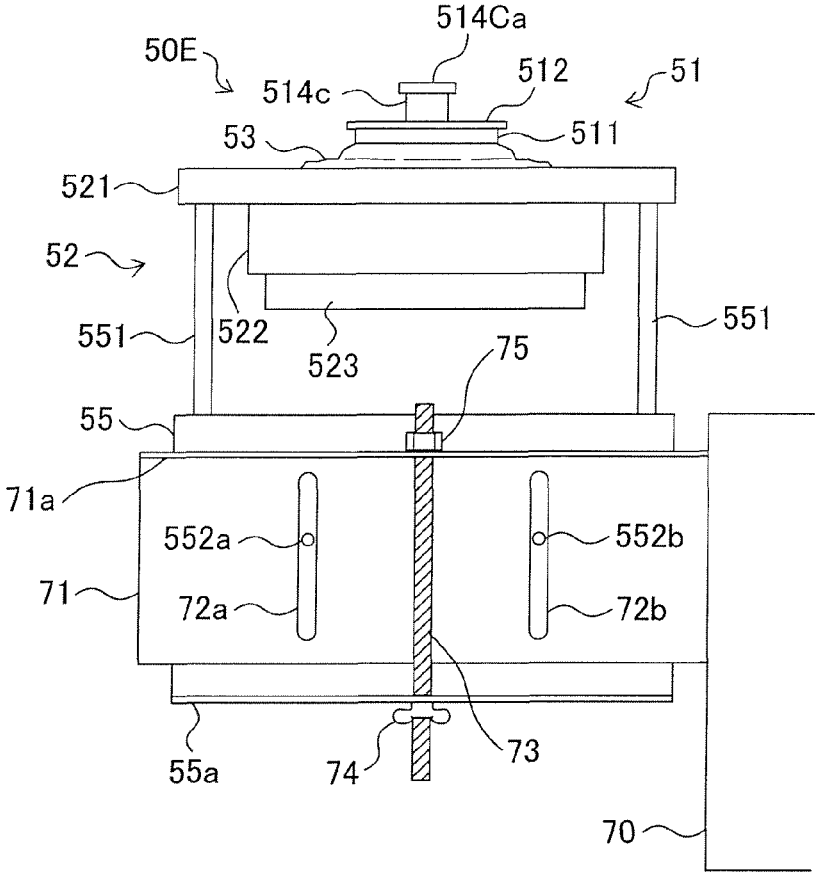
FIG. 37 is a schematic side elevational view showing a mechanism for adjusting a height of a fifth embodiment of the vibration device of the present invention.

FIG. 37 is a schematic side elevational view showing a mechanism for adjusting a height of a fifth embodiment of the vibration device of the present invention. Like each of the above-described embodiments, the fifth embodiment of the vibration device 50E comprises the vibration member 51, the magnetic circuit member 52 and the damper 53, the magnetic circuit member 52 includes the top plate 521, the magnet 522 and the yoke 523, and the vibration member 51 includes the bobbin 511 having the voice coil. The cap 512 is joined to the upper end of the bobbin 511, a shaft 514C extends upward from the upper surface of the cap 512, and the upper end of the shaft 514C is constructed to function as a connecting portion 514Ca. Let it be assumed that, in the fifth embodiment, the shaft 514C is fixed in length like the shaft in the above-described second embodiment. Note, however, that the shaft of the length-adjustable type provided in the first, third or fourth embodiment may be employed as the shaft 514C. Further, like the vibration device described above in relation to FIG. 9 or the like, the vibration device 50E is connected to and supported by the support section 55 via the plurality of support rods 551. The support section 55 is supported in such a manner as to be adjustable in length via a pair of height adjusting plates 71 provided on left and right side surfaces of the support section 55. The pair of height adjusting plates 71 is fixed to a suitable base section 70 (e.g., the aforementioned vertical strut 9 of the piano, floor or the like).

Each of the height adjusting plate 71 has a pair of elongated guide holes 72*a* and 72*b* extending in a vertical (up-down) direction, and each of the side surfaces of the support section 55 has projections 552*a* and 552*b* fittable in the elongated guide holes 72*a* and 72*b* of a corresponding one of the height adjusting plates 71. An upper edge portion of the height adjusting plate 71 is bent at the right angle or in the horizontal direction to provide an angle portion (or horizontal flange) 71*a*. A lower edge portion of the height adjusting plate 71 is also bent at the right angle or in the horizontal direction to provide an angle portion (or horizontal flange) 55*a*. An elongated bolt 73 is used to interconnect the upper and lower angle portions 71*a* and 55*a* with a length therebetween adjusted. For this purpose, the upper-edge angle portion 71*a* of the height adjusting plate 71 has a bolt passing hole, and the lower-edge angle portion 55*a* of the height adjusting plate 71 too has a bolt passing hole. A butterfly nut 74 is disposed on the lower surface side of the lower-edge angle portion 55*a* of the support section 55 and screwed on the bolt 73. Further, a nut 75 is disposed on the upper surface side of the upper-edge angle portion 71*a* of the support section 55 and screwed on the bolt 73. The support section 55 can be moved downward by loosening the butterfly nut 74 and moved upward by tightening the butterfly nut 74.

According to the fifth embodiment constructed in the above-described manner, the support section 55 can be adjusted in height position as desired. Thus, during assembly, the support section 55 can be raised in position until the distal-end connecting portion 514Ca of the vibration member 51 of the vibration device 50E abuts against the reverse face of the sound board 7, so that the connecting portion 514Ca is adhesively joined to the sound board 7; also, the support section 55 is maintained at that raised height position. Note that the term "height" of the support section 55 does not necessarily mean a height in the vertical direction but means a distance between the support section 55 and the sound board 7 (relative distance between the support section 55 and the sound board 7) in a direction from the support section 55 toward the connection end portion 514Ca (or 516A or the like) of the vibration device 50E (or 50 or the like). Therefore, in cases where the instant embodiment is applied to a piano of a type having the sound board standing in the vertical direction, height adjustment of the support section 55 means adjustment of a position, in a horizontal direction toward the sound board, of the support section 55.

[Summary]

As described above in relation to each of the embodiments, the present invention can be implemented as a voice coil type actuator, such as the vibration device 50-50E, which imparts vibration to the sound board 7. According to another aspect, the present invention can be implemented as a keyboard musical instrument, such as the grand piano 1, or other type of musical instrument provided with a voice coil type actuator, such as the vibration device 50-50E as described above, which imparts vibration to the sound board 7. Note that an object to which the vibration device 50-50E is to be attached is not limited to an acoustic piano and may be an electronic piano or any other desired musical instrument that can be provided with a sound board, such as a guitar having a sound board, a new type of musical instrument where a speaker having a sound board is sounded in response to an operation of a performance operator. In any case, it just suffices that the vibration device 50-50E be attached to the musical instrument having the sound board, a drive signal corresponding to an operation of the performance operator be output to the vibration device 50-50E and the vibration device 50-50E function as an actuator that drives the sound board in accordance with the drive signal. In these cases, the magnetic circuit member 52 is supported by a member like the support section fixed to the casing of any one of the musical instruments. Rather than being limited to the aforementioned, the present invention can also be implemented as a method for attaching a voice coil type actuator by performing operations as shown in FIGS. 6 and 24, and a method for manufacturing a musical instrument provided with a voice coil type actuator.

Although not particularly described in detail above, part of the constituent elements or features of any of the above-described various embodiments may be applied to any of the other embodiments wherever possible.

What is claimed is:

1. An actuator for vibrating a sound board of a musical instrument comprising:

a magnetic path formation section constructed to form a magnetic path space;

a bobbin having a voice coil attached thereto in such a manner that the voice coil is disposed within the magnetic path space; and a connection member connected to said bobbin and constructed to vibrate in response to vibration of said bobbin, said connection member having a connection end adapted for connection to the sound board of the musical instrument, said connection member being constructed to be adjustable in length, wherein said connection member includes an end member forming the connection end, and a portion having a greater thermal conductivity than the end member.

2. An actuator for vibrating a sound board of a musical instrument comprising:

a magnetic path formation section constructed to form a magnetic path space;

a bobbin having a voice coil attached thereto in such a manner that the voice coil is disposed within the magnetic path space; and a connection member connected to said bobbin and constructed to vibrate in response to vibration of said bobbin, said connection member having a connection end adapted for connection to the sound board of the musical instrument, said connection member being constructed to be adjustable in length, wherein said connection member includes a cap having a flat surface fixed to an opening portion of the bobbin, and a heat measuring device for measuring a temperature of the flat surface of the cap is mounted on the flat surface of the cap.

3. An actuator for vibrating a sound board of a musical instrument comprising:

a magnetic path formation section constructed to form a magnetic path space;

a bobbin having a voice coil attached thereto in such a manner that the voice coil is disposed within the magnetic path space; and a connection member connected to said bobbin and constructed to vibrate in response to vibration of said bobbin, said connection member having a connection end adapted for connection to the sound board of the musical instrument, said connection member being constructed to be adjustable in length, wherein the sound board has a sound board rib provided thereon, and said connection member is connected at the connection end to a side of the sound board where the sound board rib is provided, said connection member being connected and fixed to the sound board with the length thereof adjusted in such a manner that a distance from said bobbin to the connection end is greater than a height of the sound board rib from the sound board.

4. The actuator as claimed in claim 3, wherein said connection member includes a rod-shaped member, and a screw structure for converting rotational displacement of the rod-shaped member to linear displacement of the rod-shaped member.

5. The actuator as claimed in claim 3, wherein said connection member includes: a first member connected to said bobbin; a second member connected to said first member in such a manner that said second member is displaceable relative to said first member; and a tightening tool adapted to tighten and fix a connected portion between said first member and said second member.

6. The actuator as claimed in claim 3, which further comprises a reference position instructing member for indicating a reference mounting position, within the magnetic path space, of the voice coil.

7. The actuator as claimed in claim 3, which further comprises a damper connecting said bobbin to said magnetic path formation section in such a manner that said bobbin is disposed within the magnetic path space.

8. A musical instrument comprising: the actuator recited in claim 3; the support section supporting the magnetic path formation section; the sound board having the connection end connected thereto; a performance operator; and a signal generation section constructed to generate a drive signal indicative of an audio waveform corresponding to an operation of said performance operator, the drive signal being supplied to said actuator for driving the voice coil.

9. A method for attaching to a musical instrument the actuator recited in claim 3, said method comprising: a step of providing a support section in association with an actuator-attaching position of the sound board to which the actuator is to be attached and installing the magnetic path formation section on the support section; a step of connecting the connection end to the sound board with a length of the connection member adjusted in such a manner that the connection end is moved toward the sound board; and a step of fixing the length of the connection member adjusted in such a manner that the connection end is connected to the sound board.

10. The method as claimed in claim 9, wherein said adjusting a length of the connection member comprises adjusting the length of the connection member while maintaining a reference mounting position, within the magnetic path space, of the voice coil.

11. The method as claimed in claim 10, wherein the reference position instructing member for indicating a reference mounting position, within the magnetic path space, of the voice coil is used to maintain the reference mounting position, within the magnetic path space, of the voice coil.

12. The method as claimed in claim 10, which further comprises a step of, prior to said step of connecting the connection end to the sound board, adjusting a distance, relative to the sound board, of the support section having the magnetic path formation section installed thereon.

13. A method for manufacturing a musical instrument provided with the actuator recited in claim 3, said method comprising: a step of providing a musical instrument that is not provided with the actuator; a step of providing a support section in association with an actuator-attaching position of the sound board to which the actuator is to be attached and installing the magnetic path formation section on the support section; a step of connecting the connection end to the sound board after adjusting the length of the connection member in such a manner that the connection end is moved toward the sound board; and a step of fixing the length of the connection member adjusted in such a manner that the connection end is connected to the sound board.

14. A device for vibrating a sound board of a musical instrument, comprising:

an actuator including: a magnetic path formation section constructed to form a magnetic path space; a bobbin having a voice coil attached thereto in such a manner that the voice coil is disposed within the magnetic path space; and a connection member connected to said bobbin and to the sound board of the musical instrument and adapted to transmit vibration of the bobbin to the sound board, said connection member being constructed to be adjustable in length;

a support section disposed in association with an actuator-attaching position of the sound board to which the actuator is to be attached; and an adjustment device constructed to adjust a relative distance of said support section to the sound board, wherein the sound board has a sound board rib provided thereon, and said connection member is connected at the connection end to a side of the sound board where the sound board rib is provided, said connection member being connected and fixed to the sound board with the length thereof adjusted in such a manner that a distance from said bobbin to the connection end is greater than a height of the sound board rib from the sound board.

* * * * *